US005968104A

United States Patent [19]

Egawa et al.

[11] Patent Number: 5,968,104

[45] Date of Patent: Oct. 19, 1999

[54] FRONT CONTROL SYSTEM FOR CONSTRUCTION MACHINE

[75] Inventors: Eiji Egawa, Tsuchiura; Kazuo Fujishima; Masakazu Haga, both of Ibaraki-ken; Hiroshi Watanabe, Ushiku, all of Japan

[73] Assignee: Hitachi Construction Machinery Co., Ltd., Tokyo, Japan

[21] Appl. No.: 08/880,506

[22] Filed: Jun. 23, 1997

[30] Foreign Application Priority Data

Jun. 26, 1996 [JP] Japan ..... 8-166376

[51] Int. Cl.[6] ..... E02F 3/43

[52] U.S. Cl. ..... 701/50; 414/699; 37/414

[58] Field of Search ..... 701/50; 37/414, 37/415; 414/699, 700, 701; 172/4, 4.5

[56] References Cited

U.S. PATENT DOCUMENTS

| | | | |
|---|---|---|---|
| 4,260,941 | 4/1981 | Engelberger et al. | 318/568 |
| 4,894,598 | 1/1990 | Daggett | 318/599 |
| 5,701,691 | 12/1997 | Watanabe et al. | 701/50 |
| 5,735,065 | 4/1998 | Yamagata et al. | 701/50 |
| 5,768,810 | 6/1998 | Ahn | 701/50 |
| 5,835,874 | 11/1998 | Hirata et al. | 701/50 |
| 5,845,223 | 12/1998 | Song | 701/50 |
| 5,860,480 | 1/1999 | Jayaraman et al. | 701/50 |

FOREIGN PATENT DOCUMENTS

| | | |
|---|---|---|
| 426264 | 5/1991 | European Pat. Off. . |
| 512 584 | 11/1992 | European Pat. Off. . |
| 735 202 | 2/1996 | European Pat. Off. . |
| 747 541 | 11/1996 | European Pat. Off. . |
| 4-136324 | 5/1992 | Japan . |
| 5-98671 | 4/1993 | Japan . |
| 6-307404 | 11/1994 | Japan . |
| WO94/26988 | 11/1994 | WIPO . |
| WO95/33100 | 7/1995 | WIPO . |
| WO95/30059 | 9/1995 | WIPO . |

*Primary Examiner*—Gary Chin

*Attorney, Agent, or Firm*—Fay, Sharpe, Beall, Fagan, Minnich & McKee

[57] ABSTRACT

An area where a front device (1A) is allowed to move is set beforehand and the operation of the front device is controlled so that the front device will not go out of the set area. For this control process, an arm cylinder speed calculating portion (9*d*) of a control unit (9) estimates an arm cylinder speed for use in control by taking the sum of a low-frequency component of an arm cylinder speed which is derived through coordinate transformation and differentiation of an arm rotational angle detected by an angle sensor (8*b*), and a high-frequency component of an arm cylinder speed which is derived from a command value applied from a control lever unit (14*b*) to a flow control valve (15*b*) for an arm and a flow rate characteristic of the flow control valve (15*b*). The control unit controls the operation of the front device with the estimated operating speed. The operation of the front device is thereby controlled smoothly and accurately regardless of change in any parameters, such as load and fluid temperature, affecting the flow rate characteristic of the flow control valve.

13 Claims, 25 Drawing Sheets

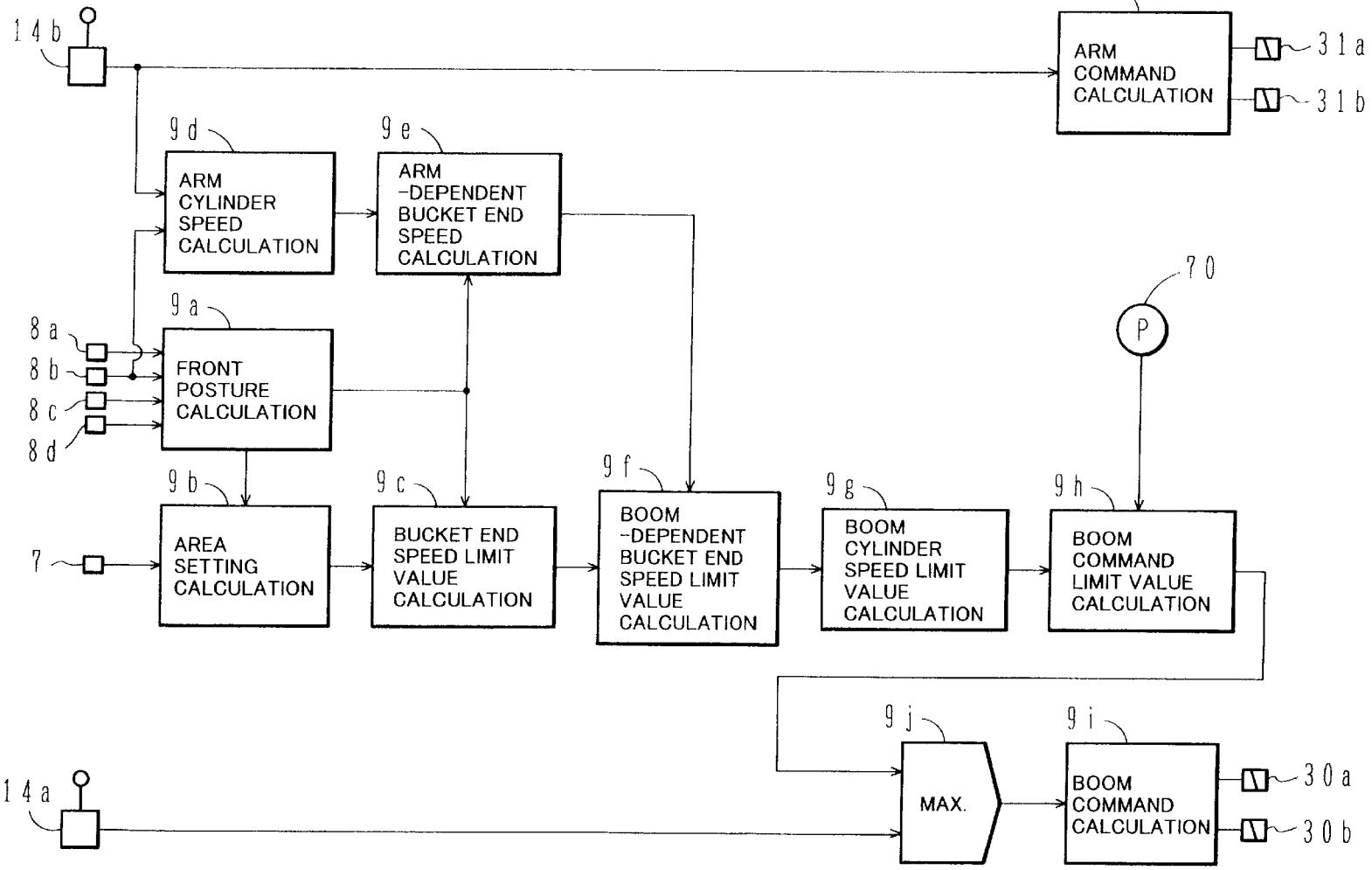
FIG.4
ARM COMMAND CALCULATION
9k
31a
31b
P
70
BOOM COMMAND LIMIT VALUE CALCULATION
9h
BOOM COMMAND CALCULATION
9i
30a
30b
BOOM CYLINDER SPEED LIMIT VALUE CALCULATION
9g
MAX.
9j
BOOM -DEPENDENT BUCKET END SPEED LIMIT VALUE CALCULATION
9f
ARM -DEPENDENT BUCKET END SPEED CALCULATION
9e
BUCKET END SPEED LIMIT VALUE CALCULATION
9c
ARM CYLINDER SPEED CALCULATION
9d
FRONT POSTURE CALCULATION
9a
AREA SETTING CALCULATION
9b
14b
8a
8b
8c
8d
7
14a

FLOW RATE CHARACTERISTIC

FRONT CONTROL SYSTEM FOR CONSTRUCTION MACHINE

BACKGROUND OF THE INVENTION

1. Field of the Invention

The present invention relates to a construction machine having a multi-articulated front device, and more particularly to a front control system for a construction machine, e.g., a hydraulic excavator having a front device comprising a plurality of front members such as an arm, a boom and a bucket, which system modifies a signal from at least one control lever unit and controls the operation of the front device for performing area limiting excavation control to limit an area where the front device is allowed to move, locus limiting excavation control to move an end of the front device along a predetermined locus, etc.

2. Description of the Related Art

There is known a hydraulic excavator as typical one of construction machines. In a hydraulic excavator, front members, such as a boom and an arm, making up a front device are operated by an operator manipulating respective manual control levers. However, because the front members are coupled to each other through articulations for relative rotation, it is very difficult to carry out excavation work within a predetermined area or in a predetermined plane by operating the front members. Also, there is known a hydraulic excavator with a front device including an offset (second boom) for providing a wider excavation area, or a very small swivel-type hydraulic excavator capable of swiveling within a body width. But such a hydraulic excavator accompanies a risk that a front device may interfere with a cab depending on its posture.

In view of the above-mentioned state of art, various proposals for facilitating excavation work or preventing interference between the front device and the cab have been made.

For example, JP-A-4-136324 proposes that, with the aid of a slowdown area set in a position before reaching an entrance forbidden area, a front device is slowed down by reducing an operation signal input from a control lever when a part, e.g., a bucket, of the front device enters the slowdown area, and is stopped when the bucket reaches the boundary of the entrance forbidden area.

Also, WO95/30059 proposes that an excavation area is set beforehand, and a part, e.g., a bucket, of a front device is controlled to slow down its movement only in the direction toward the excavation area when the bucket comes close to the boundary of the excavation area, and to be able to move along the boundary of the excavation area without going out of the excavation area when the bucket reaches the boundary of the excavation area. More specifically, to realize the above control, the position and posture of each of front members, such as a boom and an arm, are calculated based on signals from position detecting means, e.g., angle sensors. Operating speeds (e.g., speeds of a boom cylinder, an arm cylinder, etc.) at which the front members, such as a boom and an arm, are moved in accordance with signals from respective control lever units are estimated based on calculated values of the position and posture of each of the front members, as well as the signals from the respective control lever units. Then, the signals from the respective control lever units are modified in consideration of the estimated operating speeds.

Further, WO95/33100 proposes that, in the area limiting excavation control system disclosed in the above-cited WO95/30059, respective load pressures of hydraulic actuators such as a boom cylinder and an arm cylinder are detected, and the signals from the respective control lever units are modified in consideration of the detected load pressures as well, thus enabling the bucket to be controlled with high accuracy regardless of change in the load pressures of the hydraulic actuators.

SUMMARY OF THE INVENTION

The above control systems in the related art have, however, problems as follows.

With the control system disclosed in the above-cited JP-A-4-136324, since the front device is slowed down by reducing the operation signal input from the control lever when the bucket enters the slowdown area, and is stopped when the bucket reaches the boundary of the entrance forbidden area, the bucket can be smoothly stopped at the boundary of the entrance forbidden area.

But this related-art control system is designed to reduce the speed of the front device such that the speed is always reduced regardless of the direction in which the bucket is moving. Accordingly, when excavation work is to be performed along the boundary of the entrance forbidden area, the digging speed in the direction along the boundary of the entrance forbidden area is also reduced as the bucket approaches the entrance forbidden area with the operation of the arm. This requires the operator to manipulate a boom lever to move the bucket away from the entrance forbidden area each time the digging speed is reduced, in order to prevent a drop of the digging speed. As a result, the working efficiency is extremely reduced in excavation work along the entrance forbidden area.

With the control system disclosed in the above-cited WO95/30059, since the bucket is controlled to slow down its movement only in the direction toward the excavation area when the bucket comes close to the boundary of the excavation area, and to be able to move along the boundary of the excavation area without going out of the excavation area when the bucket reaches the boundary of the excavation area, the drawback in the above related-art control system can be overcome and excavation work can be smoothly and efficiently performed within a limited area.

Meanwhile, when the operating speeds of the front members such as the boom and the arm are estimated in the above related-art control systems, the speeds of the boom cylinder, the arm cylinder and so on are estimated based on the (operation) signals input from the control lever units.

Generally, the flow rates of a hydraulic fluid (oil) supplied to actuators such as a boom cylinder, an arm cylinder, etc. and hence the speeds of those actuators are controlled by respective flow control valves associated with the actuators. However, characteristics of flow rates of the hydraulic fluid supplied to the actuators versus input signals to the flow control valves (opening areas thereof) are not constant, but depend on load pressures, fluid temperature, and other parameters. For example, even with the same input signal (opening area), as the load pressure of the actuator rises, the hydraulic fluid is more hard to flow to the actuator, resulting in a reduction in the flow rate of the hydraulic fluid supplied to the actuator and hence a reduction in the speed of the actuator. Likewise, even with the same input signal (opening area), as the fluid temperature lowers, the viscosity of the hydraulic fluid is increased, resulting in a reduction in the flow rate of the hydraulic fluid supplied to the actuator and hence a reduction in the speed of the actuator.

In the above related-art control systems wherein the actuator speeds are estimated based on the operation signals, the flow rate characteristics of the flow control valves are varied upon change in the load pressure, the fluid temperature, and other parameters. This may reduce the control accuracy and may bring about a hunting due to instability caused by change in control gain. Further, even when load compensating valves or the like are installed upstream or downstream of the flow control valves, the flow rate characteristics of the flow control valves are unavoidably affected by accuracy of the load compensating valves and change in the fluid temperature.

With the control system disclosed in the above-cited WO95/33100, since the signals from the control lever units are modified in consideration of the load pressures of the actuators as well, the bucket can be controlled with higher accuracy than in the control system disclosed in the above-cited WO95/30059 regardless of change in the load pressures of the hydraulic actuators. However, the control system of WO95/33100 is adaptable for only change in the load pressures of the hydraulic actuators, but not for change in other parameters, e.g., fluid temperature, affecting the flow rate characteristics of the flow control valves.

An object of the present invention is to provide a front control system for a construction machine which can control the operation of a front device smoothly and accurately regardless of change in any parameters, e.g., load and fluid temperature, affecting the flow rate characteristics of flow control valves, and a recording medium in which a program enabling such control to be performed is recorded.

(1) To achieve the above object, the present invention provides a front control system equipped on a construction machine comprising a multi-articulated front device made up of a plurality of front members rotatable in the vertical direction, a plurality of hydraulic actuators for driving respectively the plurality of front members, a plurality of operating means for instructing respective operations of the plurality of front members, and a plurality of hydraulic control valves driven in accordance with respective operation signals input from the plurality of operating means for controlling flow rates of a hydraulic fluid supplied to the plurality of hydraulic actuators, the control system comprising first detecting means for detecting status variables in relation to a position and posture of the front device; first calculating means for calculating the position and posture of the front device based on signals from the first detecting means; and second calculating means employing a signal from first particular one of the plurality of operating means and estimating an operating speed of a first particular front member driven by a first particular hydraulic actuator associated with the first particular operating means based on the position and posture of the front device calculated by the first calculating means, the estimated operating speed being utilized to control operation of the front device, wherein the second calculating means includes first calculation/filter means for deriving a low-frequency component of an actual operating speed of the first particular front member based on the signal from the first detecting means, second calculation/filter means for deriving a high-frequency component of a commanded operating speed of the first particular front member based on the signal from the first particular operating means, and compositely calculating means for combining the low-frequency component of the actual operating speed and the high-frequency component of the commanded operating speed with each other and estimating the operating speed of the first particular front member for use in the control.

The commanded operating speed of the first particular front member derived based on the signal from the first particular operating means is often not exactly in agreement with the actual speed of the first particular front member even in a steady state, because the actual flow rate characteristic of the associated hydraulic control valve (flow control valve) is not constant by suffering the effect of load pressure, fluid temperature, etc. But, the commanded operating speed of the first particular front member exactly reflects abrupt change in the signal from the first particular operating means.

On the other hand, the actual operating speed of the first particular front member derived based on the actually measured signal from the first detecting means is calculated without being affected by the load pressure, the fluid temperature, etc. However, because of a delay from an issue of the command from the first particular operating means to a signal output to actuate the first particular front member, the reliability of the signal from the first particular operating means is poor for abrupt change in command value. Also, since the actual operating speed is based on the detected value, it inevitably contains noise to some degree.

In the present invention, therefore, the first calculation/filter means is provided to extract only the low-frequency component of the actual operating speed of the first particular front member derived based on the actually measured signal from the first detecting means because its high-frequency component is poor in reliability, and the second calculation/filter means is provided to extract only the high-frequency component of the commanded operating speed of the first particular front member derived based on the signal from the first particular operating means because the actual flow rate characteristic varies over time. Then, the compositely calculating means combines both the low-frequency component and the high-frequency component with each other, thereby estimating the operating speed for use in control of the first particular front member. This results in smooth control of the front device in which the control process is less affected by change in the load pressure, the fluid temperature, etc. and the effects of a signal delay and errors in the steady state are minimized.

Also, change in the flow rate characteristic of the hydraulic control valve (flow control valve) has been already reflected in the actual operating speed derived. Therefore, even if any of parameters including not only the load pressure, but also the fluid temperature and others affecting the flow rate characteristic of the hydraulic control valve is changed, it is possible to precisely estimate the operating speed of the front member and smoothly control the operation of the front device with high accuracy.

(2) In the above front control system of (1), preferably, the first calculation/filter means includes means for differentiating the signal from the first detecting means and deriving the actual operating speed of the first particular front member, and means for performing a low-pass filter process on the actual operating speed, and the second calculation/filter means includes means for deriving the commanded operating speed of the first particular front member based on the signal from the first particular operating means, and means for performing a high-pass filter process on the commanded operating speed.

With this feature, the processing functions of the first and second calculation/filter means in the above (1) can be realized.

(3) In the above front control system of (2), preferably, the means included in the first calculation/filter means for deriving the actual operating speed includes cycle number calculating means for determining the number of calculation cycles to take in the signal from the first detecting means in accordance with the signal from the first particular operating means, storage means for storing the signal from the first detecting means in the determined number of calculation cycles, including the latest calculation cycle, and means for calculating the actual operating speed of the first particular front member in accordance with a formula below;

$$\Omega_1=(\alpha_a-\alpha_{a-n})/(T\times n)$$

where the number of calculation cycles is n, the signal from the first detecting means in the latest calculation cycle is $\alpha_a$, the signal from the first detecting means before n cycles is $\alpha_{a-n}$, the period of one calculation cycle is T, and the actual operating speed of the first particular front member is $\Omega_1$.

With this feature, the first calculation/filter means can calculate the actual operating speed $\Omega_1$ based on the signal from the first detecting means.

(4) In the above front control system of (3), preferably, the cycle number calculating means determines the number n of calculation cycles such that the number of calculation cycles is reduced as the signal from the first particular operating means increases.

When the actual operating speed (angular speed) $\Omega_1$ is calculated by differentiating the signal from the first detecting means as set forth in the above (3), the calculation accuracy depends on how many cycles go back from a current value to determine the output value from the first detecting means that is to be used for the differentiation. In other words, that accuracy can be kept substantially constant by making the differentiation using the output value before a relatively large number of cycles when the signal from the operating means is small, and by making the differentiation using the output value before a relatively small number of cycles when the signal from the operating means is large.

(5) In the above front control system of (4), preferably, the means included in the second calculation/filter means for performing a high-pass filter process calculates a cutoff frequency that rises as the signal from the first particular operating means increases, and performs the high-pass filter process on the commanded operating speed by using the calculated cutoff frequency.

By thus determining the cutoff frequency depending on the magnitude of the signal from the first particular operating means, performing the high-pass filter process on the commanded operating speed with the determined cutoff frequency, and combining the filter-processed speed with the actual operating speed to thereby estimate the operating speed for use in control, a detection error that occurs at the time of rising of the signal from the first detecting means depending on the magnitude of the signal from the operating means is compensated, and an operating speed close to the correct value is obtained even at the time of rising.

(6) In the above front control system of (4), preferably, the means included in the first calculation/filter means for performing a low-pass filter process calculates a cutoff frequency that rises as the signal from the first particular operating means increases, and performs the low-pass filter process on the actual operating speed by using the calculated cutoff frequency.

(7) In the above front control system of (1), preferably, the compositely calculating means includes means for adding the low-frequency component of the actual operating speed and the high-frequency component of the commanded operating speed.

(8) In the above front control system of (7), preferably, the compositely calculating means further includes means for multiplying a gain by the high-frequency component of the commanded operating speed, and the adding means adds the product resulted from multiplying the gain by the high-frequency component of the commanded operating speed and the low-frequency component of the actual operating speed.

With this feature, the compensation for a delay at the time of signal rising can be set to an optimum degree depending on the magnitude of inertia of the second particular front member. When the second particular front member is, e.g., a boom of a hydraulic excavator, it is expected that the boom has so large inertia as to cause a delay in response at the time of rising. But, by setting the gain, which is to be multiplied by the high-frequency component of the commanded operating speed, to a relatively large value (not less than one (1) ) and calculating the operating speed of the first particular front member (e.g., an arm) to have an overly estimated value, the boom target speed is also calculated to be relatively large at the time of rising, and the effect of compensating the response delay is achieved.

(9) In the above front control system of (1), preferably, the front control system further comprises area setting means for setting an area where the front device is allowed to move; third calculating means employing the operating speed of the first particular front member estimated by the second calculating means and estimating an operating speed of the front device based on the position and posture of the front device calculated by the first calculating means; fourth calculating means employing the operating speed of the front device estimated by the third calculating means and calculating, based on the position and posture of the front device calculated by the first calculating means, a limit value of an operating speed of a second particular front member required for limiting a speed of the front device moving in the direction toward a boundary of the set area, when the front device is positioned inside the set area near the boundary thereof and the first particular front member is moved at the estimated operating speed; and signal modifying means for modifying a signal from a second particular operating means associated with the second particular front member so that the operating speed of the second particular front member will not exceed the limit value; the signal modifying means calculating a limit value of the signal from the second particular operating means based on the limit value of the operating speed of the second particular front member and modifying the signal from the second particular operating means so that the signal from the second particular operating means will not exceed the limit value.

With this feature, the fourth calculating means calculates the limit value of the operating speed of the second particular front member and the signal modifying means modifies the signal from the second particular operating means, thereby performing direction change control to slow down the movement of the front device in the direction toward the boundary of the set area. This enables the front device to be moved along the boundary of the set area. It is therefore possible to efficiently and smoothly perform the excavation within a limited area.

(10) In the above front control system of (1), preferably, the actual operating speed and the commanded operating speed of the first particular front member are each a speed of the first particular hydraulic actuator.

(11) In the above front control system of (1), the actual operating speed and the commanded operating speed of the first particular front member may be each an angular speed of the first particular front member.

(12) In the above front control system of (1), preferably, the first particular front member is an arm of a hydraulic excavator and the second particular front member is a boom of the hydraulic excavator.

(13) Also, to achieve the above object, the present invention provides a recording medium recording a control program for controlling operation of a multi-articulated front device made up of a plurality of front members rotatable in the vertical direction with a computer, wherein the control program instructs the computer to calculate a position and posture of the front device, estimate an operating speed of first particular one of the plurality of front members based on the calculated position and posture of the front device, and calculate an operation command value for the front device by using the estimated operating speed, and the control program further instructs the computer, when estimating the operating speed of the first particular front member, to derive a low-frequency component of an actual operating speed of the first particular front member and a high-frequency component of a commanded operating speed of the first particular front member, and combine the low-frequency component of the actual operating speed and the high-frequency component of the commanded operating speed with each other.

With the front control system constructed using such a recording medium, similarly to the above system of (1), even if any of parameters such as the load pressure, the fluid temperature and others affecting the flow rate characteristic of the hydraulic control valve is changed, the front device can be easily controlled while achieving a reduction in cost.

BRIEF DESCRIPTION OF THE DRAWINGS

FIG. 4 is a functional block diagram showing control functions of the control unit.

DETAILED DESCRIPTION OF THE PREFERRED EMBODIMENTS

Several embodiments of the present invention will be described hereunder with reference to the drawings, taking area limiting excavation control in a hydraulic excavator as one example of front control in a construction machine.

To begin with, a first embodiment of the present invention will be described with reference to FIGS. 1 to 10.

Figure 1:
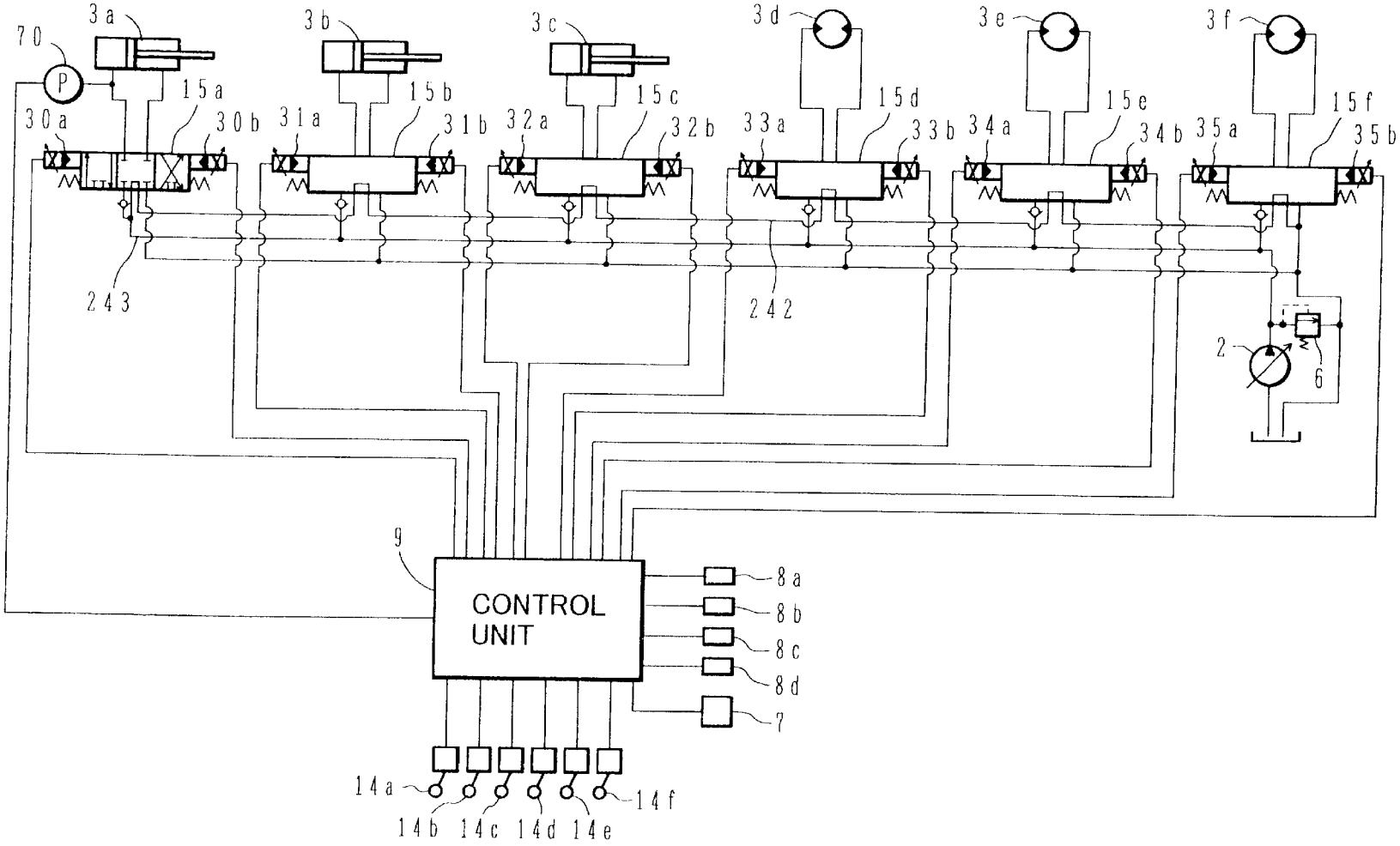
FIG. 1 is a diagram showing a front control system (area limiting excavation control system) for a construction machine according to a first embodiment of the present invention, along with a hydraulic drive system thereof.

In FIG. 1, a hydraulic excavator to which the present invention is applied comprises a hydraulic pump 2, a plurality of hydraulic actuators driven by a hydraulic fluid from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 14*a*–14*f* provided respectively associated with the hydraulic actuators 3*a*–3*f*, a plurality of flow control valves 15*a*–15*f* connected between the hydraulic pump 2 and the plurality of hydraulic actuators 3*a*–3*f* and controlled in accordance with respective operation signals input from the control lever units 14*a*–14*f* for controlling respective flow rates of the hydraulic fluid supplied to the hydraulic actuators 3*a*–3*f*, and a relief valve 6 which is opened when the pressure between the hydraulic pump 2 and the flow control valves 15*a*–15*f* exceeds a preset value. The above components cooperatively make up a hydraulic drive system for driving driven members of the hydraulic excavator.

Figure 2:
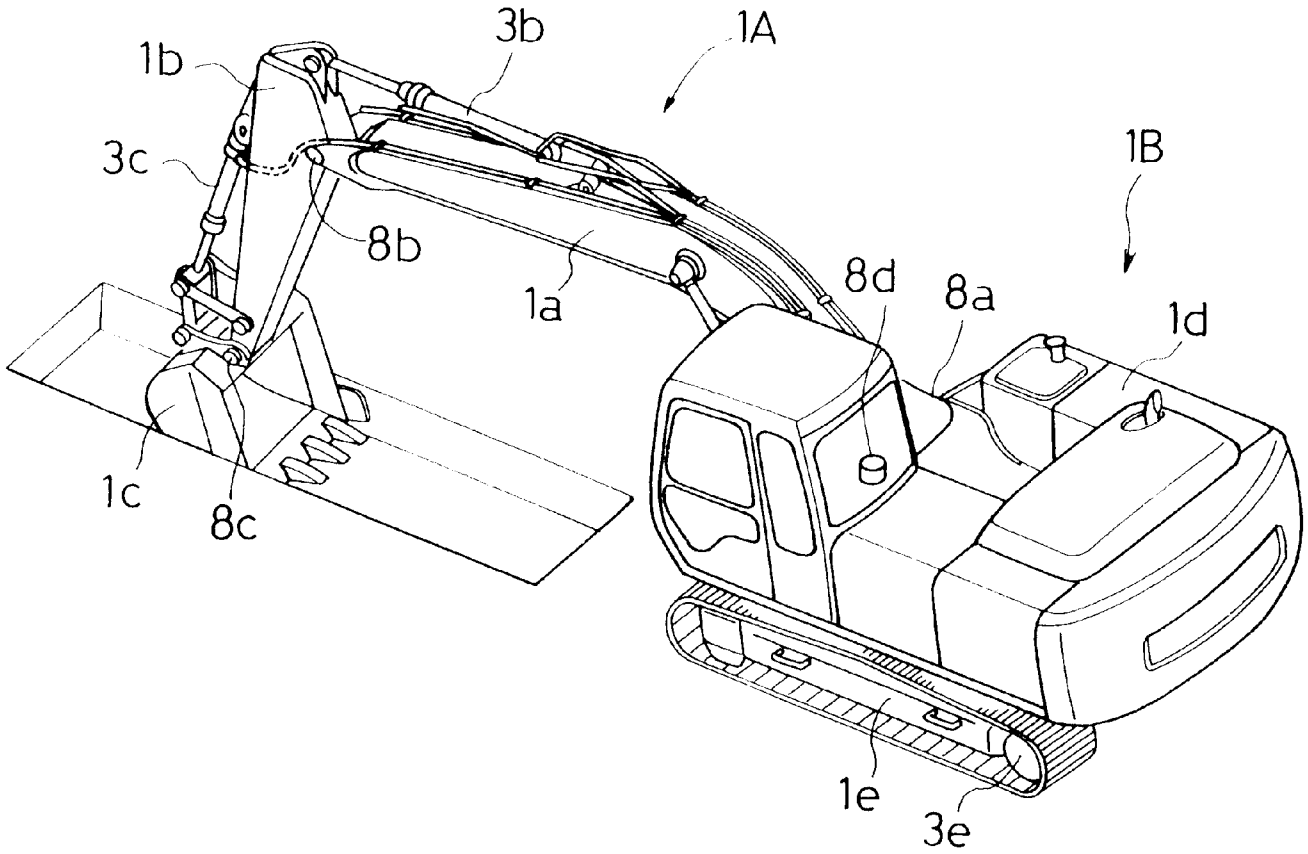
FIG. 2 is a view showing an appearance of a hydraulic excavator to which the present invention is applied.

As shown in FIG. 2, the hydraulic excavator is made up of a multi-articulated front device 1A comprising a boom 1*a*, an arm 1*b* and a bucket 1*c* which are each rotatable in the vertical direction, and a body 1B comprising an upper structure 1*d* and an undercarriage 1*e*. The boom 1*a* of the front device 1A is supported at its base end to a front portion of the upper structure 1*d*. The boom 1*a*, the arm 1*b*, the bucket 1*c*, the upper structure 1*d* and the undercarriage 1*e* serve as driven members which are driven respectively by the boom cylinder 3*a*, the arm cylinder 3*b*, the bucket cylinder 3*c*, the swing motor 3*d* and the left and right track motors 3*e*, 3*f*. These driven members are operated in accordance with instructions from the control lever units 14*a*–14*f*.

The control lever units 14*a*–14*f* are of electric lever type outputting electric signals (voltages) as the operation signals. The flow control valves 15*a*–15*f* have at opposite ends thereof electro-hydraulic converting means, e.g., solenoid driving sectors 30*a*, 30*b*–35*a*, 35*b* including proportional solenoid valves, and voltages depending on the input amounts and directions by and in which the control lever units 14*a* to 14*f* are manipulated by the operator are supplied as electric signals from the control lever units 14*a*–14*f* to the solenoid driving sectors 30*a*, 30*b*–35*a*, 35*b* of the associated flow control valves 15*a*–15*f*.

The flow control valves 15*a*–15*f* are center-bypass type flow control valves. Respective center bypass passages of the flow control valves are interconnected by a center bypass line 242 in series. The center bypass line 242 is connected an its upstream end to the hydraulic pump 2 through a supply line 243, and at its downstream end to a reservoir.

An area limiting excavation control system according to this embodiment is equipped on the hydraulic excavator constructed as explained above. The control system comprises a setting device 7 for providing an instruction to set an excavation area where a predetermined part of the front device, e.g., an end of the bucket 1*c*, is allowed to move, depending on the scheduled work beforehand, angle sensors 8*a*, 8*b*, 8*c* disposed respectively at pivot points of the boom 1*a*, the arm 1*b* and the bucket 1*c* for detecting respective rotational angles thereof as status variables in relation to the position and posture of the front device 1A, a tilt angle sensor 8*d* for detecting a tilt angle of the body 1B in the back-and-forth direction, a pressure sensor 70 for detecting a load pressure of the boom cylinder 3*a* exerted on the bottom side thereof when the boom is moved upward, and a control unit 9 for receiving the operation signals from the control lever units 14*a*–14*f*, a setup signal from the setting device 7 and detection signals from the angle sensors 8*a*, 8*b*, 8*c*, the tilt angle sensor 8*d* and the pressure sensor 70, setting an excavation area where the end of the bucket 1*c* is allowed to move, and modifying the operation signals to carry out control for excavation within a limited area.

The setting device 7 comprises manipulation means, such as a switch, disposed on a control panel or grip for outputting a setup signal to the control unit 9 to instruct setting of the excavation area. Other suitable aid means such as a display may be provided on the control panel. As an alternative, the setting of the excavation area may be instructed by any of other suitable methods such as using IC cards, bar codes, lasers, and wireless communication.

Figure 3:
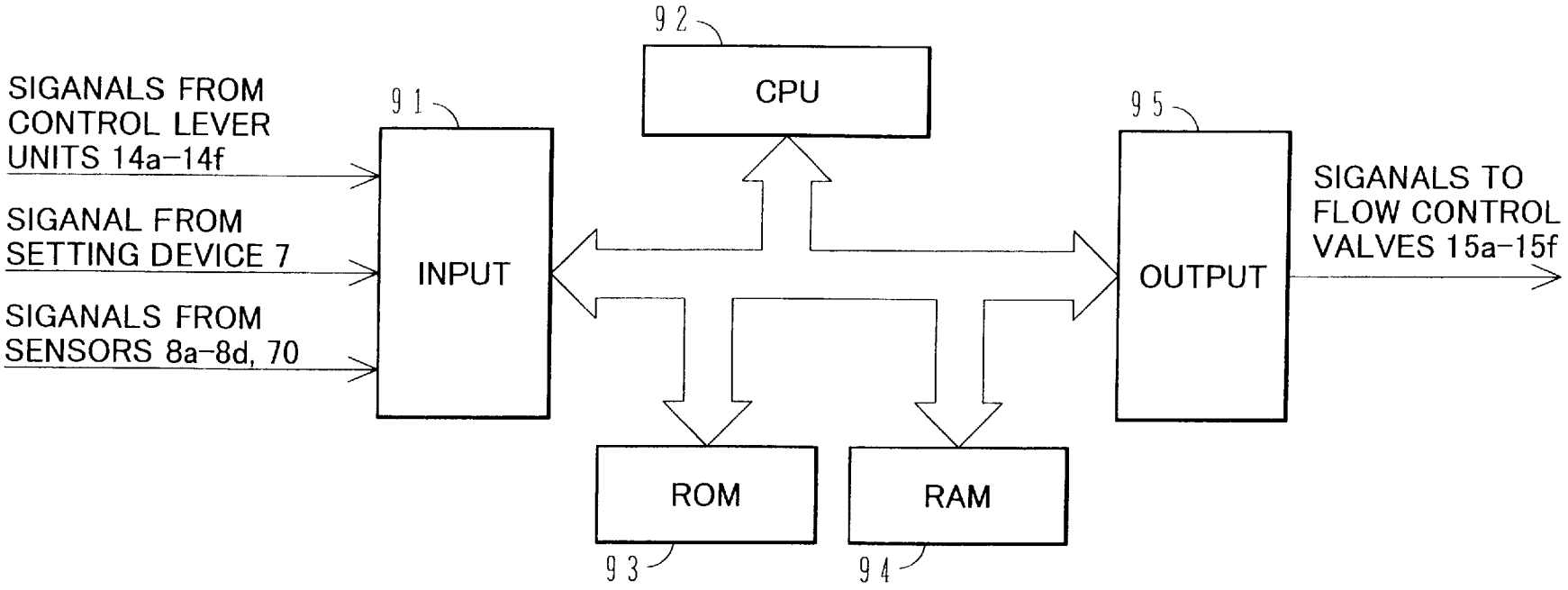
FIG. 3 is a block diagram schematically showing the internal configuration of a control unit.

FIG. 3 shows the internal configuration of the control unit 9. The control unit 9 is constituted by a microcomputer and comprises an input portion 91, a central processing unit (CPU) 92, a read only memory (ROM) 93, a random access memory (RAM) 94, and an output portion 95. The input portion 91 receives the operation signals from the control lever units 14*a*–14*f*, the setup signal from the setting device 7 and the detection signals from the angle sensors 8*a*, 8*b*, 8*c*, the tilt angle sensor 8*d* and the pressure sensor 70, and performs A/D-conversion of these signals into digital signals. The ROM 93 stores control programs (described later) therein. The CPU 92 executes predetermined arithmetic operations for the signals taken into it from the input portion 91 in accordance with the control programs stored in the ROM 93. The RAM 94 temporarily stores numerical values during the process of arithmetic operations. The output portion 95 creates output signals in accordance with the calculation results in the CPU 92, and outputs those signals to the flow control valves 15*a*–15*f*.

An outline of the control programs stored in the ROM 93 of the control unit 9 is shown in FIG. 4 in the form of a block diagram. The control unit 9 includes various functions executed by a front posture calculating portion 9*a*, an area setting calculating portion 9*b*, a bucket end speed limit value calculating portion 9*c*, an arm cylinder speed calculating portion 9*d*, an arm-dependent bucket end speed calculating portion 9*e*, a boom-dependent bucket end speed limit value calculating portion 9*f*, a boom cylinder speed limit value calculating portion 9*g*, a boom command limit value calculating portion 9*h*, a boom command maximum value calculating portion 9*j*, a boom command calculating portion 9*i*, and an arm command calculating portion 9*k*.

The front posture calculating portion 9*a* calculates the position and posture of the front device 1A based on respective rotational angles of the boom, the arm and the bucket detected by the angle sensors 8*a*–8*c*, as well as a tilt angle of the body 1B in the back-and-forth direction detected by the tilt angle sensor 8*d*.

The area setting calculating portion 9*b* executes calculation for setting of the excavation area where the end of the bucket 1*c* is allowed to move, in accordance with an instruction from the setting device 7. One example of a manner of setting the excavation area will be described with reference to FIG. 5.

Figure 5:
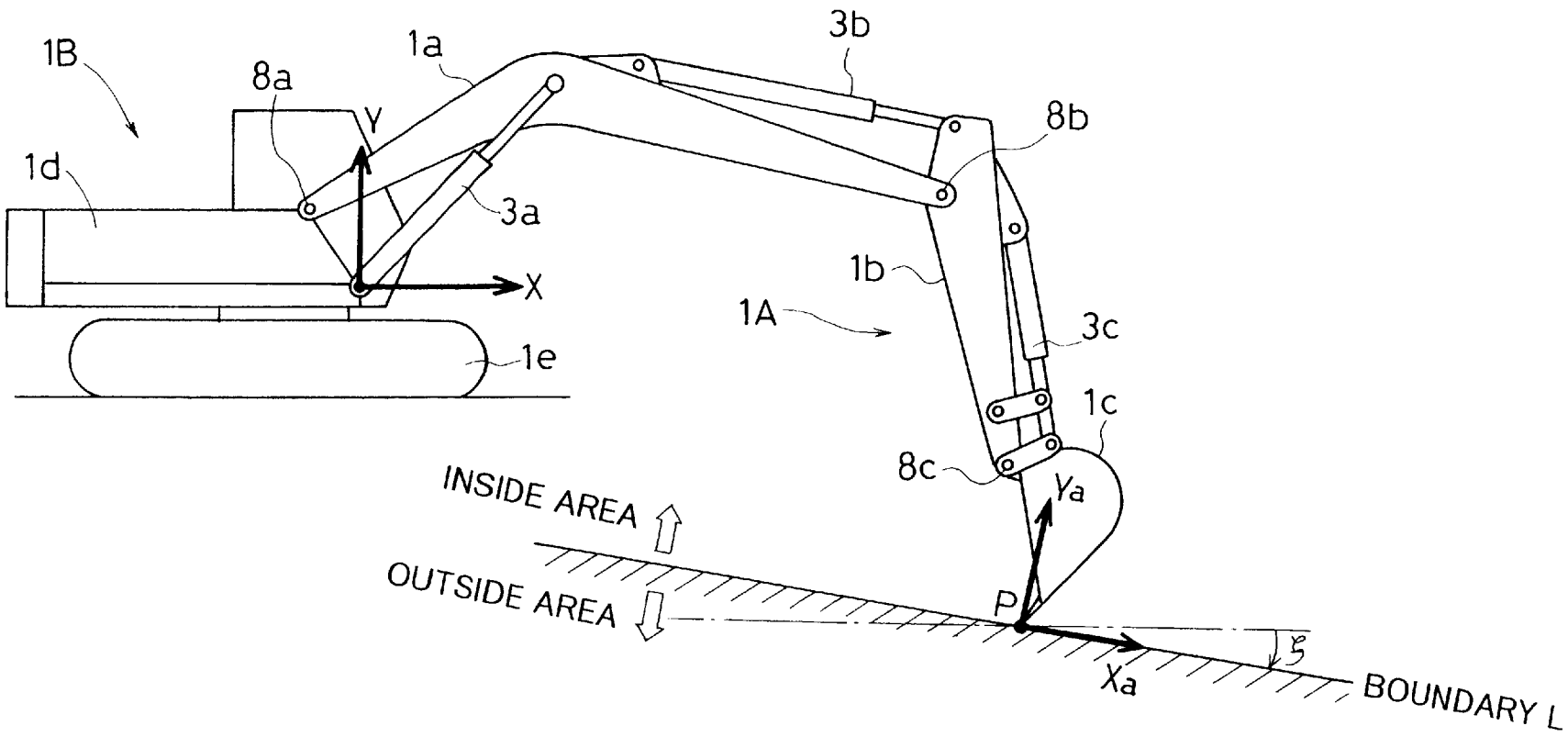
FIG. 5 is a view for explaining a manner of setting an excavation area for use in area limiting excavation control according to the first embodiment.

In FIG. 5, after the end of the bucket 1*c* has been moved to the position of a point P upon the operator manipulating the front device, the end position of the bucket 1*c* at that time is calculated in response to an instruction from the setting device 7. Then, a boundary L of the limited excavation area is set based on a tilt angle ζ instructed from the setting device 7.

Here, the control unit 9 stores various dimensions of the front device 1A and the body 1B in its memory, and the area setting calculating portion 9*b* calculates the position of the point P, in cooperation with the front posture calculating portion 9*a*, based on the stored data, the rotational angles detected respectively by the angle sensors 8*a*, 8*b*, 8*c*, and the tilt angle of the body 1B detected by the tilt angle sensor 8*d*. At this time, the position of the point P is determined, by way of example, as coordinate values on an XY-coordinate system with the origin defined by the pivot point of the boom 1*a*. The XY-coordinate system is a rectangular coordinate system assumed to lie in a vertical plane which is fixed onto the body 1B.

Then, the area setting calculating portion 9*b* derives a formula of a straight line expressing the boundary L of the limited excavation area based on the position of the point P and the tilt angle ζ instructed from the setting device 7, and establishes an XaYa-coordinate system having the origin located on that straight line and one axis defined by that straight line, e.g., an XaYa-coordinate system with the origin defined by the point P. Further, the area setting calculating portion 9*b* determines transform data from the XY-coordinate system to the XaYa-coordinate system.

The bucket end speed limit value calculating portion 9*c* calculates a limit value a of the component of the bucket end speed vertical to the boundary L of the set area depending on a distance D to the bucket end from the boundary L. This calculation is carried out by storing the relationship as shown in FIG. 6 in the memory of the control unit 9 beforehand and reading out the stored relationship.

Figure 6:
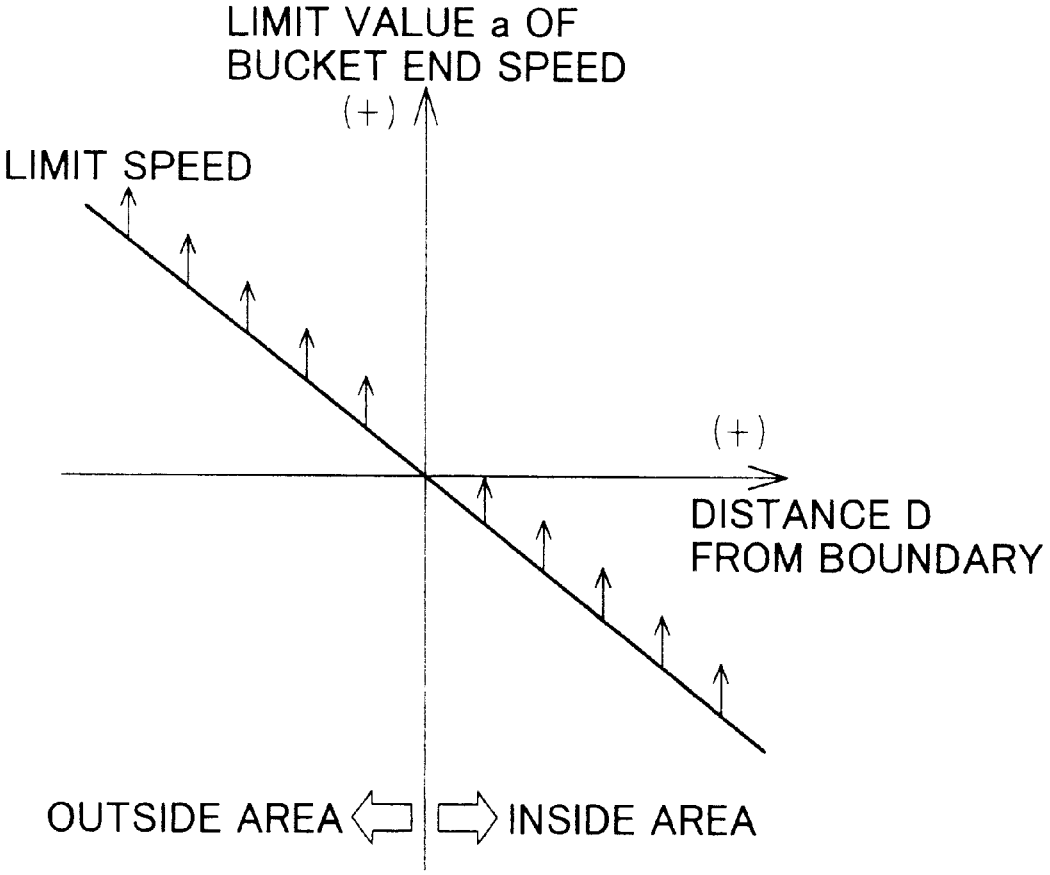
FIG. 6 is a graph showing the relationship between a distance to a bucket end from a boundary of the set area and a bucket end speed limit value, the relationship being used when the limit value is determined.

In FIG. 6, the horizontal axis represents the distance D to the bucket end from the boundary L of the set area, and the vertical axis represents the limit value a of the component of the bucket end speed vertical to the boundary L. As with the XaYa-coordinate system, the distance D on the horizontal axis and the speed limit value a on the vertical axis are each defined to be positive (+) in the direction toward the inside of the set area from the outside of the set area. The relationship between the distance D and the limit value a is set such that when the bucket end is inside the set area, a speed in the negative (−) direction proportional to the distance D is given as the limit value a of the component of the bucket end speed vertical to the boundary L, and when the bucket end is outside the set area, a speed in the positive (+) direction proportional to the distance D is given as the limit value a of the component of the bucket end speed vertical to the boundary L. Accordingly, inside the set area, the bucket end is slowed down only when the component of the bucket end speed vertical to the boundary L exceeds the limit value in the negative (−) direction, and outside the set area, the bucket end is sped up in the positive (+) direction.

In this embodiment, the relationship between the distance D to the bucket end from the boundary L of the set area and the limit value a of the bucket end speed is set to be linearly proportional. But the relationship is not limited thereto, but may be set in various ways.

The arm cylinder speed calculating portion 9*d* estimates an arm cylinder speed for use in control by taking the sum of a low-frequency component of the arm cylinder speed which has been derived through coordinate transformation and differentiation of the arm rotational angle detected by the angle sensor 8*b*, and a high-frequency component of the arm cylinder speed which has been derived from a command value applied from the control lever unit 14*b* to the flow control valve 15*b* for the arm and the flow rate characteristic of the flow control valve 15*b*.

Figure 7:
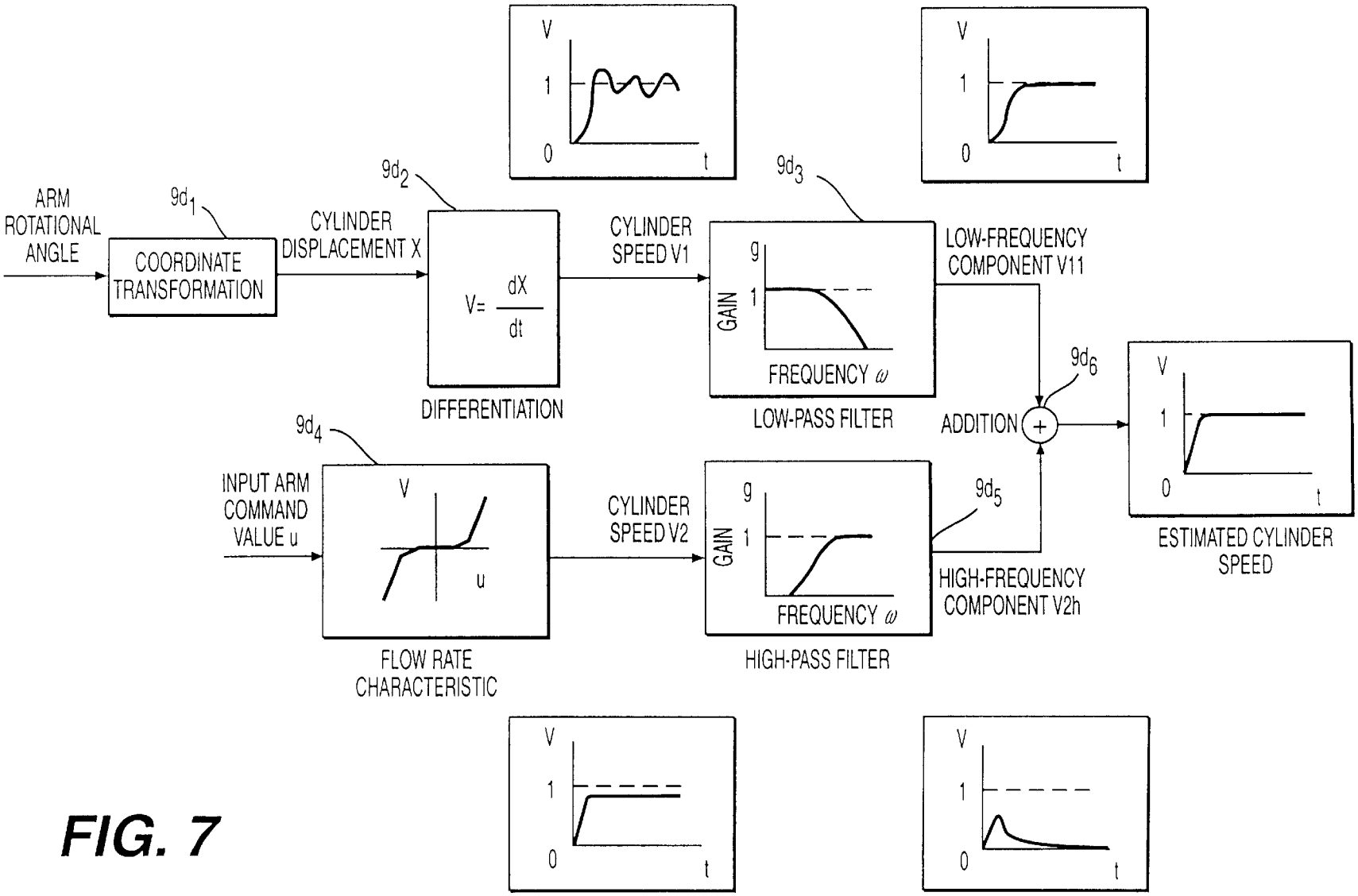
FIG. 7 is a functional block diagram showing details of calculation of an arm cylinder speed.

FIG. 7 shows details of a calculation process executed in the arm cylinder speed calculating portion 9*d*. In FIG. 7, the arm cylinder speed calculating portion 9*d* comprises an arm cylinder displacement calculating portion 9*d*1, a differentiating portion 9*d*2, a low-pass filter portion 9*d*3, a flow characteristic calculating portion 9*d*4, a high-pass filter portion 9*d*5, and an adder portion 9*d*6.

The arm cylinder displacement calculating portion 9*d*1 executes coordinate transformation of the arm rotational angle detected by the angle sensor 8*b*, and determines an arm cylinder displacement X. Subsequently, the differentiating portion 9*d*2 differentiates the arm cylinder displacement X and determines an arm cylinder speed V1. Then, the low-pass filter portion 9*d*3 determines a low-frequency component V11 of the arm cylinder speed V1. The flow characteristic calculating portion 9*d*4 determines an arm cylinder speed V2 from an arm command value u and the known flow rate characteristic of the arm-associated flow control valve 15*b*. Then, the high-pass filter portion 9*d*5 determines a high-frequency component V2*h* of the arm cylinder speed V2. Further, the adder portion 9*d*6 determines the sum of the low-frequency component V11 and the high-frequency component V2*h* of the arm cylinder speed V2, thereby estimating an arm cylinder speed to be used for control of the boom.

Here, the arm cylinder speed V2 derived from the arm command value and the known flow rate characteristic of the arm-associated flow control valve 15*b* is often not exactly in agreement with the actual speed of the arm cylinder 3*b* even in a steady state, because the actual flow rate characteristic of the flow control valve 15*b* is not constant upon effects of the load pressure, the fluid temperature, etc. of the arm cylinder 3*b*. However, the actual flow rate characteristic of the flow control valve 15*b* exactly reflects abrupt change in the arm command value.

On the other hand, the arm cylinder speed V1 based on the actually measured arm rotational angle is calculated without being affected by the load pressure of the arm cylinder 3*b*, the fluid temperature, etc. But because of a delay from an issue of the command from the control lever unit 14*b* to a signal output to actuate the arm, the reliability of the arm cylinder speed V1 is poor for abrupt change in the arm command value. Also, since the arm cylinder speed V1 is based on the detected value, it inevitably contains noise to some degree.

Therefore, as described above, the arm cylinder speed calculating portion 9*d* employs only the low-frequency component V11 of the arm cylinder speed V1 derived from the actually measured arm rotational angle because its high-frequency component is poor in reliability, and only the high-frequency component V2*h* of the arm cylinder speed V2 derived from the known flow rate characteristic of the flow control valve 15*b* because the actual flow rate characteristic varies over time. The arm cylinder speed for use in control of the boom is then estimated by taking the sum of the low-frequency component V11 and the high-frequency component V2*h*. Accordingly, the arm cylinder speed can be estimated under conditions where it is less affected by change in the load pressure of the arm cylinder 3*b*, the fluid temperature, etc. and the effects of a signal delay and errors in the steady state are minimized.

Also, change in the flow rate characteristic of the flow control valve 15*b* has been already reflected in the arm cylinder speed V1 which represents an actually measured value. Therefore, even if any of parameters including not only the load pressure, but also the fluid temperature and others affecting the flow rate characteristic of the flow control valve 15*b* is changed, it is possible to precisely estimate the arm cylinder speed and smoothly control the operation of the front device with high accuracy.

The arm-dependent bucket end speed calculating portion 9*e* estimates an arm-dependent bucket end speed b for use in control based on the arm cylinder speed for use in control estimated in the arm cylinder speed calculating portion 9*d* and the position and posture of the front device 1A determined in the front posture calculating portion 9*a*.

The boom-dependent bucket end speed limit value calculating portion 9*f* transforms the arm-dependent bucket end speed b, which has been determined in the calculating portion 9*e*, from the XY-coordinate system to the XaYa-coordinate system by using the transform data determined in the area setting calculating portion 9*a*, calculates arm-dependent bucket end speeds ($b_x$, $b_y$), and then calculates a limit value c of the component of the boom-dependent bucket end speed vertical to the boundary L based on the limit value a of the component of the bucket end speed vertical to the boundary L determined in the calculating portion 9*c* and the component by of the arm-dependent bucket end speed vertical to the boundary L. Such a process will now be described with reference to FIG. 8.

Figure 8:
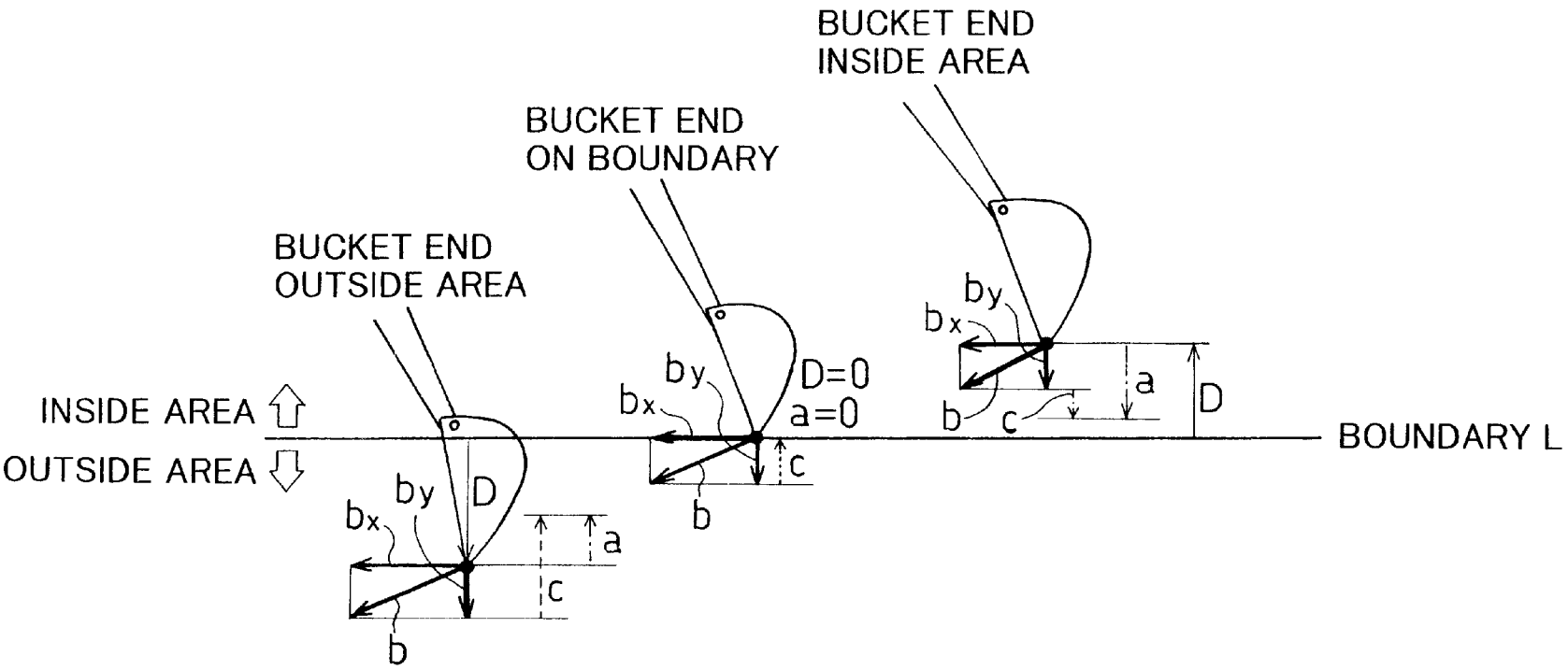
FIG. 8 is an illustrative view showing differences in operation of modifying a boom-dependent bucket end speed among the case of a bucket end positioned inside the set area, the case of the bucket end positioned on the set area, and the case of the bucket end positioned outside the set area.

In FIG. 8, the difference ($a-b_y$) between the limit value a of the component of the bucket end speed vertical to the boundary L determined in the bucket end speed limit value calculating portion 9*c* and the component $b_y$ of the arm-dependent bucket end speed b vertical to the boundary L determined in the arm-dependent bucket end speed calculating portion 9*e* provides a limit value c of the boom-dependent bucket end speed vertical to the boundary L. Then, the boom-dependent bucket end speed limit value calculating portion 9*f* calculates the limit value c from the formula of $c=a-b_y$.

The meaning of the limit value c will be described separately for the case where the bucket end is inside the set area, the case where the bucket end is on the boundary of the set area, and the case where the bucket end is outside the set area.

When the bucket end is inside the set area, the bucket end speed is restricted to the limit value a of the component of the bucket end speed vertical to the boundary L in proportion to the distance D to the bucket end from the boundary L and, therefore, the component of the boom-dependent bucket end speed vertical to the boundary L is restricted to c ($=a-b_y$). Namely, if the component $b_y$ of the bucket end speed b vertical to the boundary L exceeds c, the boom is slowed down to c.

When the bucket end is on the boundary L of the set area, the limit value a of the component of the bucket end speed vertical to the boundary L is set to 0, and the arm-dependent bucket end speed b toward the outside of the set area is canceled out through the compensating operation of boom-up at the speed c. Thus, the component $b_y$ of the bucket end speed vertical to the boundary L becomes 0.

When the bucket end is outside the set area, the component of the bucket end speed vertical to the boundary L is restricted to the upward speed a in proportion to the distance D to the bucket end from the boundary L. Thus, the compensating operation of boom-up at the speed c is always performed so that the bucket end is restored to the inside of the set area.

The boom cylinder speed limit value calculating portion 9*g* calculates a limit value of the boom cylinder speed through the coordinate transformation using the aforesaid transform data based on the limit value c of the component of the boom-dependent bucket end speed vertical to the boundary L and the position and posture of the front device 1A.

Figure 9:
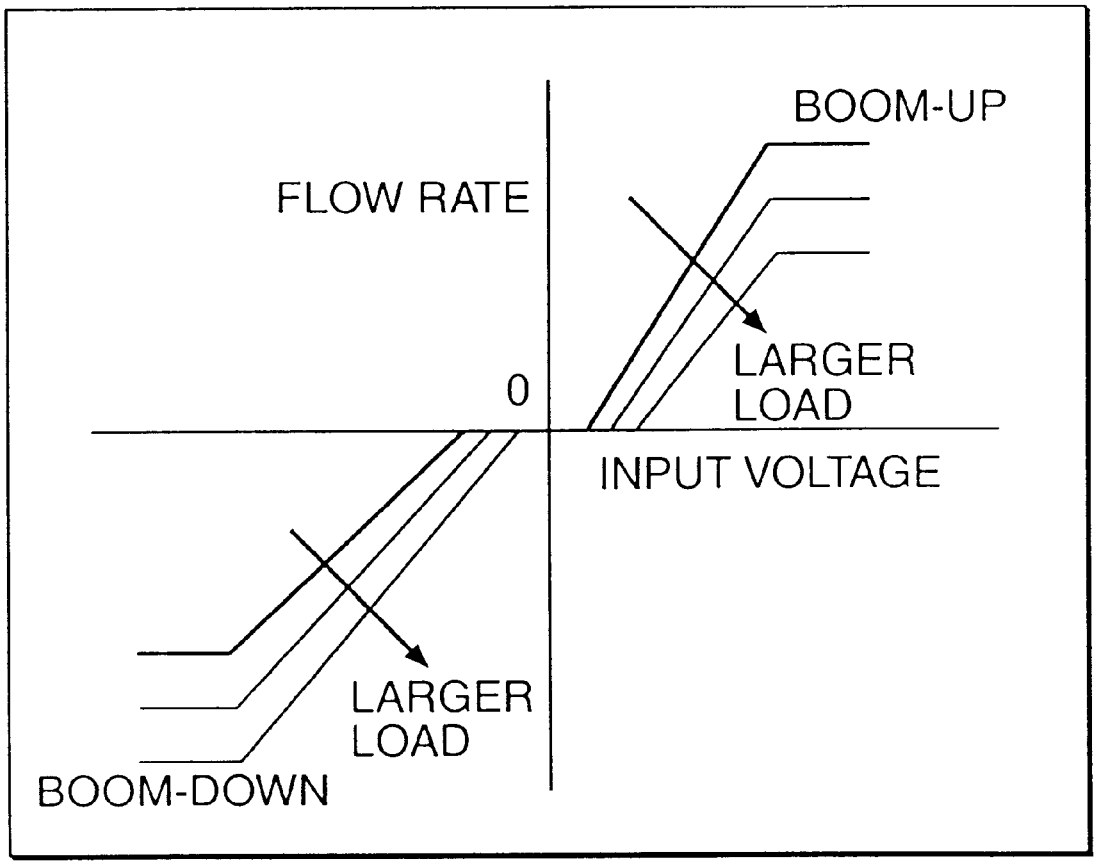
FIG. 9 is a graph showing flow rate characteristics of a flow control valve for a boom, the characteristics being used in calculating a boom command limit value.

The boom command limit value calculating portion 9*h* determines a boom command limit value corresponding to the limit value of the boom cylinder speed determined in the calculating portion 9*g*, based on the load pressure of the boom cylinder 3*a* detected by the pressure sensor 70 and the flow rate characteristic of the boom-associated flow control valve 15*a*, shown in FIG. 9, which takes the load pressure into consideration. Such load compensation made on the boom command limit value enables control to be performed under less effect of load variations of the boom cylinder 3*a*.

The boom command maximum value calculating portion 9*j* compares the boom command limit value determined in the calculating portion 9*h* with the command value from the control lever unit 14*a*, and then outputs larger one. Here, as with the XaYa-coordinate system, the command value from the control lever unit 14*a* is defined to be positive (+) in the direction toward the inside of the set area from the outside of the set area (i.e., in the boom-up direction). Also, that the calculating portion 9*j* outputs larger one of the boom command limit value and the command value from the control lever unit 14*a* means that it outputs smaller one of absolute values of both the limit values because the limit value c is negative (−) when the bucket end is inside the set area, and it outputs larger one of absolute values of both the limit values because the limit value c is positive (+) when the bucket end is outside the set area.

When the command value output from the boom command maximum value calculating portion 9*j* is positive, the boom command calculating portion 9*i* outputs a voltage corresponding to the command value to the boom-up solenoid driving sector 30*a* of the flow control valve 15*a*, and a voltage of 0 to the boom-down solenoid driving sector 30*b* thereof. When the output command value is negative, the calculating portion 9*i* outputs voltages in a reversed manner to the above.

The arm command calculating portion 9*k* receives the command value from the control lever unit 14*b*, and outputs a voltage corresponding to the command value to the arm-crowding solenoid driving sector 31*a* of the flow control valve 15*b* when the command value is positive, and a voltage of 0 to the arm-dumping solenoid driving sector 31*b* thereof. When the received command value is negative, the calculating portion 9*k* outputs voltages in a reversed manner to the above.

The operation of this embodiment having the above-explained arrangement will be described below. The following description will be made on several work examples; i,e., the case of operating the control lever of the boom control lever unit 14*a* in the boom-down direction to lower the boom with the intention of positioning the bucket end (i.e., the boom-down operation), and the case of operating the control lever of the arm control lever unit 14*b* in the arm-crowding direction to crowd the arm with the intention of digging the ground toward the body (i.e., the arm crowding operation).

When the control lever of the boom control lever unit 14*a* is operated in the boom-down direction with the intention of positioning the bucket end, the command value from the control lever unit 14*a* is input to the boom command maximum value calculating portion 9*j*. At the same time, the bucket end speed limit value calculating portion 9*c* calculates, based on the relationship shown in FIG. 6, a limit value a (<0) of the bucket end speed in proportion to the distance D to the bucket end from the boundary L of the set area, the boom-dependent bucket end speed limit value calculating portion 9*f* calculates a limit value c=a (<0) of the boom-dependent bucket end speed, and the boom command limit value calculating portion 9*h* calculates a negative boom command limit value corresponding to the limit value c. Here, when the bucket end is far away from the boundary L of the set area, the boom command limit value determined in the calculating portion 9*h* is greater than the command value from the control lever unit 14*a*, and therefore the boom command maximum value calculating portion 9*j* selects the command value from the control lever unit 14*a*. Since the selected command value is negative, the boom command calculating portion 9*i* outputs a corresponding voltage to the boom-down solenoid driving sector 30*b* of the flow control valve 15*a*, and a voltage of 0 to the boom-up solenoid driving sector 30*a* thereof. As a result, the boom is gradually moved down in accordance with the command value from the control lever unit 14*a*.

As the boom is gradually moved down and the bucket end comes closer to the boundary L of the set area as mentioned above, the limit value c=a (<0) of the boom-dependent bucket end speed calculated in the calculating portion 9*f* is increased (its absolute value |a| or |c| is reduced). Then, when the corresponding boom command limit value determined in the calculating portion 9*h* becomes greater than the command value from the control lever unit 14*a*, the boom command maximum value calculating portion 9*j* selects the former limit value and the boom command calculating portion 9*i* gradually restricts the voltage output to the boom-down solenoid driving sector 30*b* of the flow control valve 15*a* depending on the limit value c. Accordingly, the boom-down speed is gradually restricted as the bucket end comes closer to the boundary L of the set area, and the boom is stopped when the bucket end reaches the boundary L of the set area. As a result, the bucket end can be easily and smoothly positioned.

Because of the above modifying process being carried out as speed control, if the speed of the front device 1A is extremely large, or if the control lever unit 14*a* is abruptly manipulated, the bucket end may go out beyond the boundary L of the set area due to a response delay in the control process, e.g., a delay in the hydraulic circuit, inertial force imposed upon the front device 1A, and so on. When the bucket end has moved out beyond the boundary L of the set area, the limit value a (=c) of the bucket end speed in proportion to the distance D to the bucket end from the boundary L of the set area is calculated as a positive value in the calculating portion 9*c* based on the relationship shown in FIG. 6, and the boom command calculating portion 9*i* outputs a voltage corresponding to the limit value c to the boom-up solenoid driving sector 30*a* of the flow control valve 15*a*. The boom is thereby moved in the boom-up direction at a speed proportional to the distance D for restoration toward the inside of the set area, and then stopped when the bucket end is returned to the boundary L of the set area. As a result, the bucket end can be more smoothly positioned.

Further, when the control lever of the arm control lever unit 14*b* is operated in the arm-crowding direction with the intention of digging the ground toward the body, the command value from the control lever unit 14*b* is input to the arm command calculating portion 9*k* which outputs a corresponding voltage to the arm-crowding solenoid driving sector 31*a* of the flow control valve 15*b*, causing the arm to be moved down toward the body. At the same time, the arm rotational angle detected by the angle sensor 8*b* and the command value from the control lever unit 14*b* are input to the arm cylinder speed calculating portion 9*d* which estimates an arm cylinder speed for use in control through calculation. Then, the arm-dependent bucket end speed calculating portion 9*e* estimates an arm-dependent bucket end speed b for use in control through calculation. On the other hand, the bucket end speed limit value calculating portion 9*c* calculates, based on the relationship shown in FIG. 6, a limit value a (<0) of the bucket end speed in proportion to the distance D to the bucket end from the boundary L of the set area, and the boom-dependent bucket end speed limit value calculating portion 9*f* calculates a limit value $c=a-b_y$ of the boom-dependent bucket end speed. After the boom cylinder speed limit value calculating portion 9*g* calculates the limit value of the boom cylinder speed, the boom command limit value calculating portion 9*h* determines a corresponding boom command limit value based on the flow rate characteristic of the flow control valve 15*a* which takes into consideration the load pressure of the boom cylinder 3*a*. Here, when the bucket end is so far away from the boundary L of the set area as to meet the relationship of $a<b_y$ ($|a|>|b_y|$), the command value c is calculated as a negative value in the calculating portion 9*f*. Therefore, the boom command maximum value calculating portion 9*j* selects the command value (=0) from the control lever unit 14*a* and the boom command calculating portion 9*i* outputs a voltage of 0 to both the boom-up solenoid driving sector 30*a* and the boom-down solenoid driving sector 30*b* of the flow control valve 15*a*. The arm is thereby moved toward the body depending on the command value from the control lever unit 14*b*.

Figure 10:
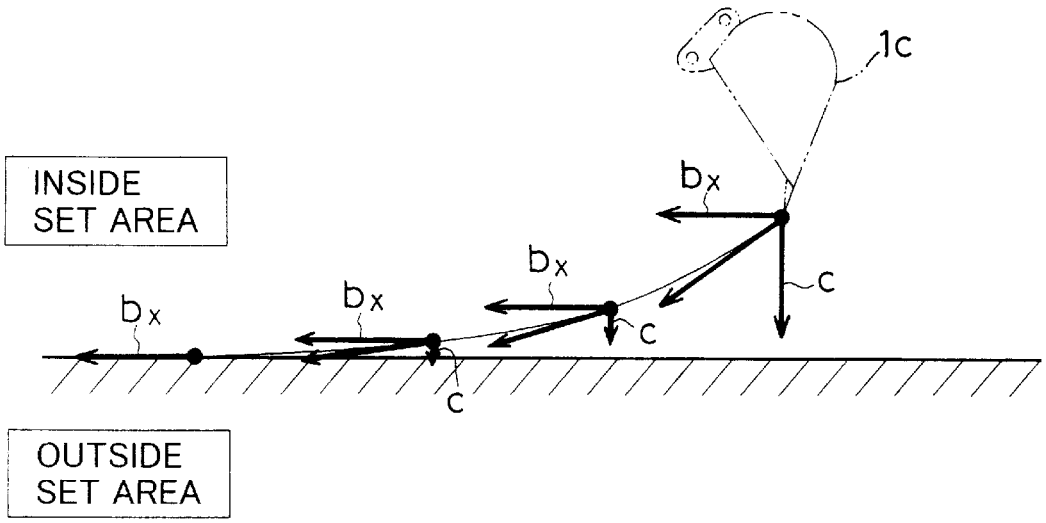
FIG. 10 is an illustrative view showing one example of a locus along which the bucket end is moved under modified operation when it is inside the set area.

As the arm is gradually moved toward the body and the bucket end comes closer to the boundary L of the set area as mentioned above, the limit value a of the bucket end speed calculated in the calculating portion 9*c* is increased (its absolute value |a| is reduced). Then, when the limit value a becomes greater than the component $b_y$ of the arm-dependent bucket end speed b vertical to the boundary L calculated in the calculating portion 9*e*, the limit value $c=a-b_y$ of the boom-dependent bucket end speed is calculated as a positive value in the calculating portion 9*f*. Therefore, the boom command maximum value calculating portion 9*j* selects the limit value calculated in the calculating portion 9*h*, and the boom command calculating portion 9*i* outputs a voltage corresponding to the limit value c to the boom-up solenoid driving sector 30*a* of the flow control valve 15*a*. Thus, the bucket end speed is modified with the boom-up operation so that the component of the bucket end speed vertical to the boundary L is gradually restricted in proportion to the distance D to the bucket end from the boundary L. Accordingly, direction change control is carried out with a resultant of the unmodified component $b_x$ of the arm-dependent bucket end speed parallel to the boundary L and the speed component vertical to the boundary L modified depending on the limit value c, as shown in FIG. 10, enabling the excavation to be performed along the boundary L of the set area.

Figure 11:
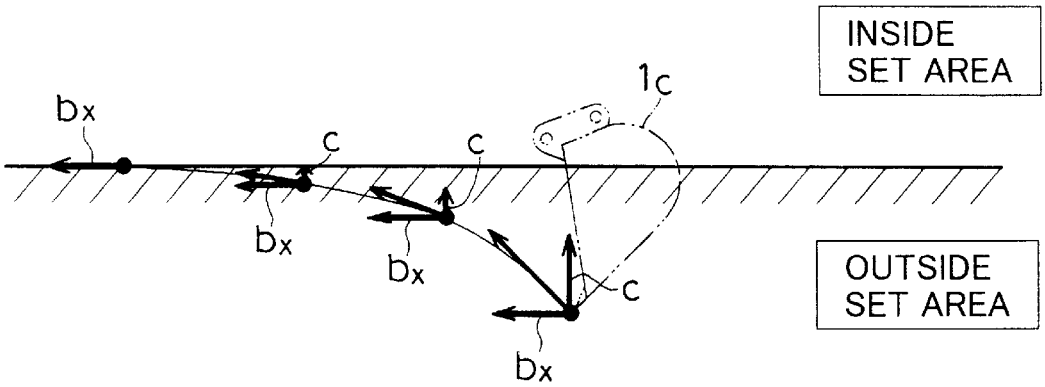
FIG. 11 is an illustrative view showing one example of a locus along which the bucket end is moved under modified operation when it is outside the set area.

Also, in this case, the bucket end may go out beyond the boundary L of the set area for the same reasons as mentioned above. When the bucket end has moved out beyond the boundary L of the set area, the limit value a of the bucket end speed in proportion to the distance D to the bucket end from the boundary L of the set area is calculated as a positive value in the calculating portion 9*c* based on the relationship shown in FIG. 6, the limit value $c=a-b_y$ (>0) of the boom-dependent bucket end speed calculated in the calculating portion 9*f* is increased in proportion to the limit value a, and the voltage output from the boom command calculating portion 9*i* to the boom-up solenoid driving sector 30*a* of the flow control valve 15*a* is increased depending on the limit value c. In the case of the bucket end going out of the set area, therefore, the boom-up operation for modifying the bucket end speed is performed so that the bucket end is restored toward the inside of the set area at a bucket end speed proportional to the distance D. Thus, the excavation is carried out under a combination of the unmodified component $b_x$ of the arm-dependent bucket end speed parallel to the boundary L and the speed component vertical to the boundary L modified depending on the limit value c, whereby excavation is performed while the bucket end is gradually returned to and moved along the boundary L of the set area as shown in FIG. 11. Consequently, the excavation can be smoothly performed along the boundary L of the set area just by crowding the arm.

With this embodiment constructed as described above, when the bucket end is inside the set area, the component of the bucket end speed vertical to the boundary L of the set area is restricted in accordance with on the limit value a in proportion to the distance D to the bucket end from the boundary L of the set area. Therefore, in the boom-down operation, the bucket end can be easily and smoothly positioned, and in the arm crowding operation, the bucket end can be moved along the boundary L of the set area. This enables the excavation to be efficiently and smoothly performed within a limited area.

When the bucket end is outside the set area, the front device is controlled to return to the set area in accordance with the limit value a in proportion to the distance D to the bucket end from the boundary L of the set area. Therefore, even when the front device is moved quickly, the front device can be moved along the boundary L of the set area and the excavation can be precisely performed within a limited area.

Further, since the bucket end is slowed down under the direction change control before reaching the boundary of the set area as described above, an amount by which the bucket end projects out of the set area is reduced and a shock caused upon the bucket end returning to the set area is greatly alleviated. Therefore, even when the front device is moved quickly, the front device can be smoothly moved in the set area and the excavation can be smoothly performed within a limited area.

Additionally, with this embodiment, the arm cylinder speed for use in control is estimated in the arm cylinder speed calculating portion 9*d* by taking the sum of the low-frequency component of the arm cylinder speed which is derived through coordinate transformation and differentiation of the arm rotational angle detected by the angle sensor 8*b*, and the high-frequency component of the arm cylinder speed which is derived from the command value applied from the control lever unit 14*b* to the flow control valve 15*b* for the arm and the flow rate characteristic of the flow control valve 15*b*. Therefore, the arm cylinder speed for use in control can be estimated under conditions where it is less affected by change in the load pressure of the arm cylinder 3*b*, the fluid temperature, etc. and the effects of a signal delay and errors in the steady state are minimized.

Also, since change in the flow rate characteristic of the flow control valve 15*b* has been already reflected in the arm cylinder speed which has been derived through coordinate transformation and differentiation of the arm rotational angle detected by the angle sensor 8*b*, it is possible to precisely estimate the arm cylinder speed and smoothly control the operation of the front device with high accuracy, even if any of parameters including not only the load pressure, but also the fluid temperature and others affecting the flow rate characteristic of the flow control valve 15*b* is changed.

Furthermore, since the boom command limit value calculating portion 9*h* determines the boom command limit value based on the flow rate characteristic of the flow control valve 15*a* which takes into consideration the load pressure of the boom cylinder 3*a*, the control can be performed under less effect of load variations.

Figure 12:
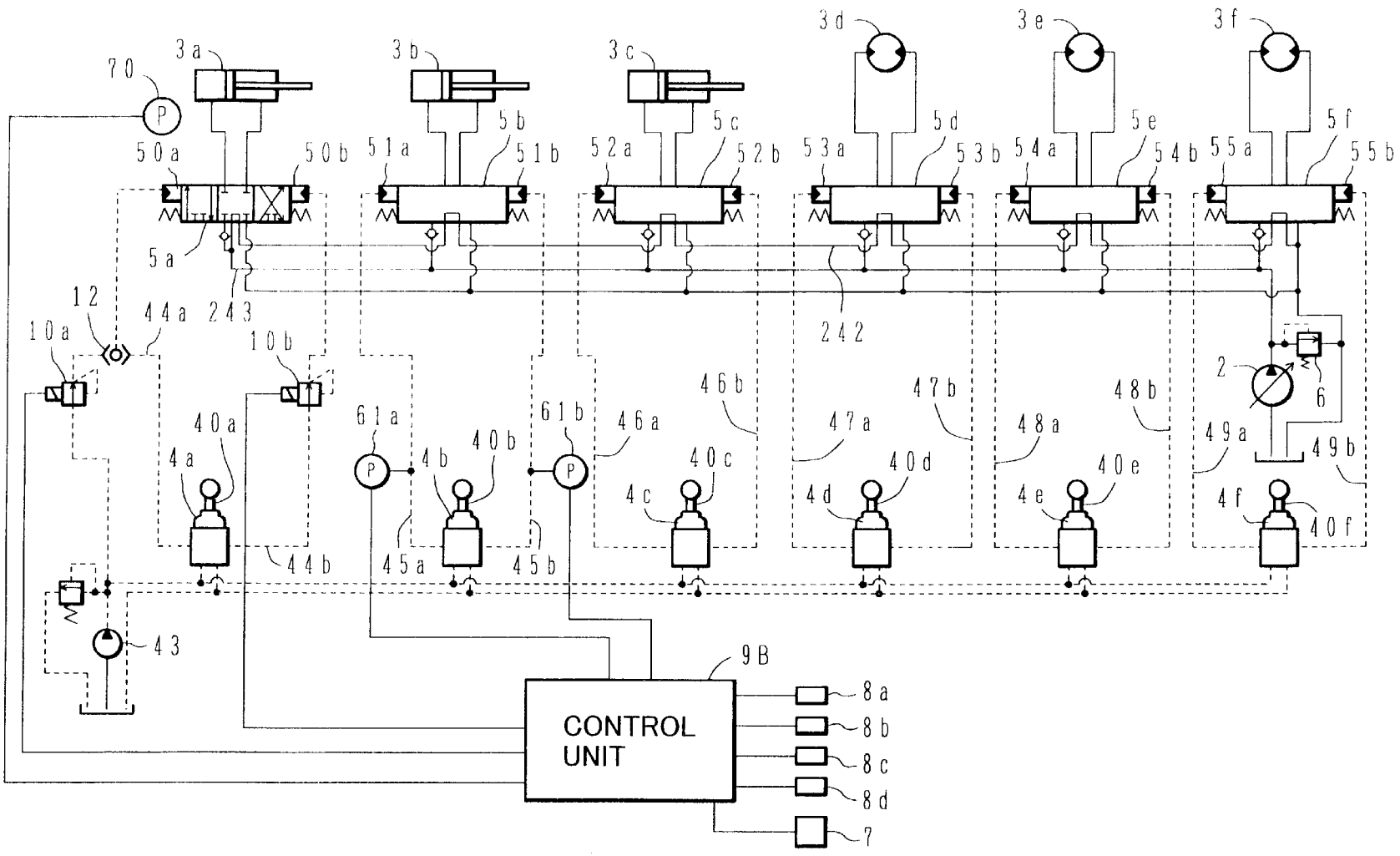
FIG. 12 is a diagram showing a front control system (area limiting excavation control system) for a construction machine according to a second embodiment of the present invention, along with a hydraulic drive system thereof.
Figure 13:
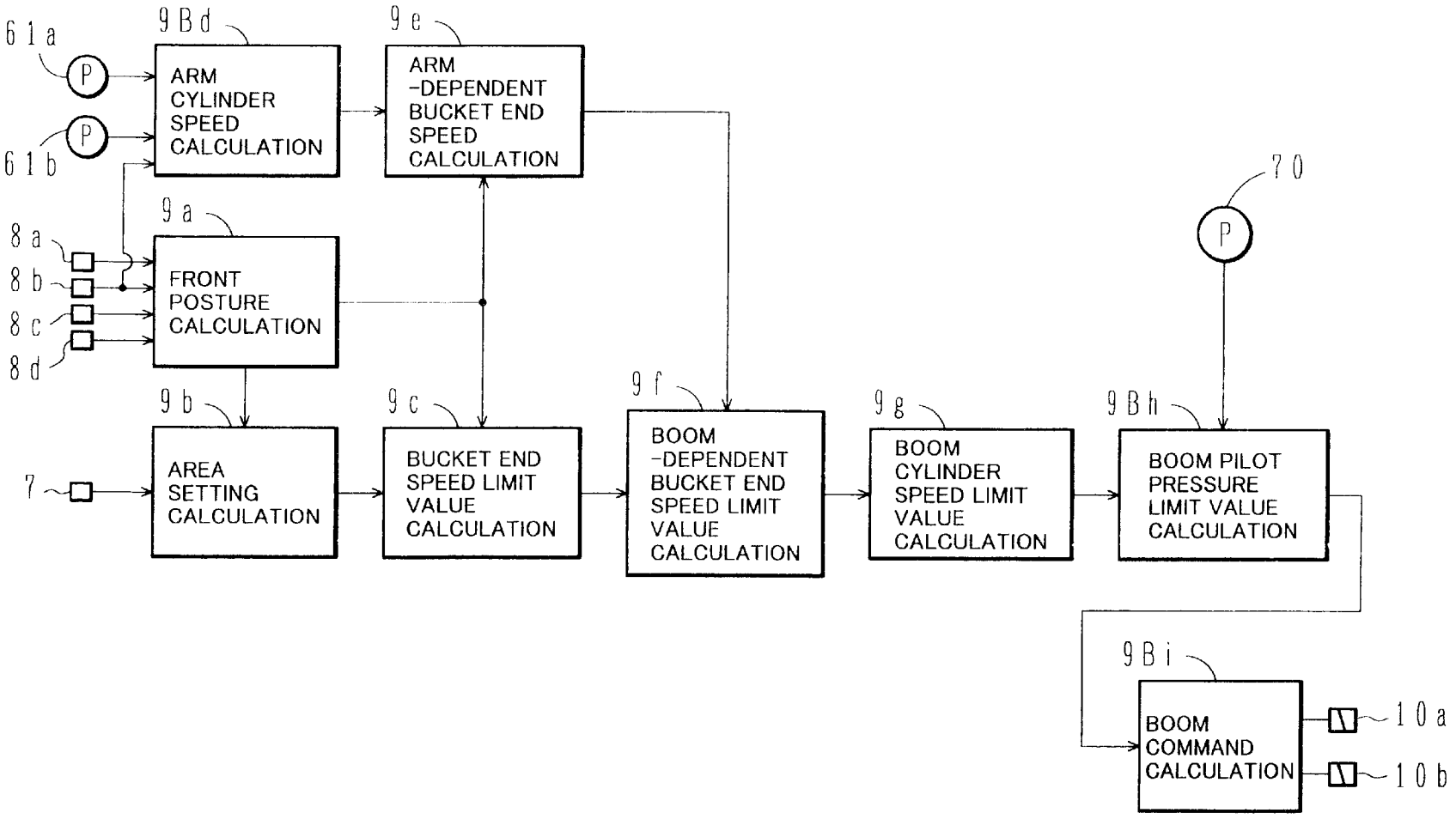
FIG. 13 is a block diagram showing control functions of a control unit.

A second embodiment of the present invention will be described with reference to FIGS. 12 and 13. In this embodiment, the present invention is applied to a hydraulic excavator employing control lever units of hydraulic pilot type. In FIGS. 12 and 13, equivalent members to those in FIG. 1 are denoted by the same reference numerals.

Referring to FIG. 12, a hydraulic excavator in which this embodiment is realized includes control lever units 4*a*–4*f* of hydraulic pilot type instead of the foregoing electric control lever units 14*a*–14*f*. The control lever units 4*a*–4*f* each drive corresponding one of flow control valves 5*a*–5*f* by a pilot pressure. The control lever units 4*a*–4*f* generate pilot pressures depending on the input amount and the direction by and in which control levers 40*a*–40*f* are manipulated $b_y$ the operator, and supply the pilot pressures to hydraulic driving sectors 50*a*–55*b* of the corresponding flow control valves through pilot lines 44*a*–49*b*.

An area limiting excavation control system of this embodiment is equipped on the hydraulic excavator constructed as explained above. The control system comprises, in addition to the components provided in the first embodiment, pressure sensors 61*a*, 61*b* disposed in the pilot lines 45*a*, 45*b* of the arm control lever unit 4*b* for detecting respective pilot pressures representative of the input amount $b_y$ which the control lever unit 4*b* is operated, a proportional solenoid valve 10*a* connected at the primary port side to a pilot pump 43 for reducing a pilot pressure from the pilot pump 43 in accordance with an electric signal applied thereto and outputting the reduced pilot pressure, a shuttle valve 12 connected to the pilot line 44*a* of the control lever unit 4*a* for the boom and the secondary port side of the proportional solenoid valve 10*a* for selecting higher one of the pilot pressure in the pilot line 44*a* and the control pressure delivered from the proportional solenoid valve 10*a* and introducing the selected pressure to the hydraulic driving sector 50*a* of the flow control valve 5*a*, and a proportional solenoid valve 10*b* disposed in the pilot line 44*b* of the boom-associated control lever unit 4*a* for reducing the pilot pressure in the pilot line 44*b* in accordance with an electric signal applied thereto and outputting the reduced pilot pressure.

Differences in control function between a control unit 9B in this embodiment and the control unit 9 in the first embodiment of FIG. 1 will be described below with reference to FIG. 13.

An arm cylinder speed calculating portion 9B*d* estimates an arm cylinder speed for use in control by taking the sum of a low-frequency component of the arm cylinder speed which is derived through coordinate transformation and differentiation of the arm rotational angle detected $b_y$ the angle sensor 8*b*, and a high-frequency component of the arm cylinder speed which is derived from a command value (pilot pressure) detected by the pressure sensor 61*a*, 61*b* and supplied to the arm-associated flow control valve 5*b*, instead of a command value applied from the control lever unit 4*b* to the flow control valve 5*b*, and the flow rate characteristic of the flow control valve 5*b*.

Also, a boom pilot pressure limit value calculating portion 9B*h* determines a boom pilot pressure (command) limit value corresponding to the limit value of the boom cylinder speed determined in the calculating portion 9*g*, based on the load pressure of the boom cylinder 3*a* detected $b_y$ the pressure sensor 70 and the flow rate characteristic of the boom-associated flow control valve 5*a* which takes the load pressure into consideration as with the flow rate characteristic shown in FIG. 9.

Further, the boom command maximum value calculating portion 9*j* is no longer required because of the provision of the proportional solenoid valves 10*a*, 10*b* and the shuttle valve 12. Instead, when the pilot pressure limit value determined in the boom pilot pressure limit value calculating portion 9B*h* is positive, a boom command calculating portion 9B*i* outputs a voltage corresponding to the limit value to the proportional solenoid valve 10*a* on the boom-up side, thereby restricting the pilot pressure applied to the hydraulic driving sector 50*a* of the flow control valve 5*a* to that limit value, and also outputs a voltage of 0 to the proportional solenoid valve 10*b* on the boom-down side, thereby making nil (0) the pilot pressure applied to the hydraulic driving sector 50*b* of the flow control valve 5*a*. When the limit value is negative, the calculating portion 9B*i* outputs a voltage corresponding to the limit value to the proportional solenoid valve 10*b* on the boom-down side, thereby restricting the pilot pressure applied to the hydraulic driving sector 50*b* of the flow control valve 5*a*, and also outputs a voltage of 0 to the proportional solenoid valve 10*a* on the boom-up side, thereby making nil (0) the pilot pressure applied to the hydraulic driving sector 50*a* of the flow control valve 5*a*.

The operation of this embodiment having the above-explained arrangement will be described below in relation to the boom-down operation and the arm crowding operation as with the first embodiment.

When the control lever of the boom control lever unit 4*a* is operated in the boom-down direction with the intention of positioning the bucket end, a pilot pressure representative of the command value from the control lever unit 4*a* is applied to the hydraulic driving sector 50*b* of the flow control valve 5*a* on the boom-down side through the pilot line 44*b*. At the same time, the bucket end speed limit value calculating portion 9*c* calculates, based on the relationship shown in FIG. 6, a limit value a (<0) of the bucket end speed in proportion to the distance D to the bucket end from the boundary L of the set area, the boom-dependent bucket end speed limit value calculating portion 9*f* calculates a limit value c=a (<0) of the boom-dependent bucket end speed, and the boom pilot pressure limit value calculating portion 9B*h* calculates a negative boom command limit value corresponding to the limit value c. Then, the boom command calculating portion 9B*i* outputs a voltage corresponding to the limit value to the proportional solenoid valve 10*b*, thereby restricting the pilot pressure applied to the hydraulic driving sector 50*b* of the flow control valve 5*a* on the boom-down side, and also outputs a voltage of 0 to the proportional solenoid valve 10*a* for making nil (0) the pilot pressure applied to the hydraulic driving sector 50*a* of the flow control valve 5*a* on the boom-up side. Here, when the bucket end is far away from the boundary L of the set area, the limit value of the boom pilot pressure determined in the calculating portion 9B*h* has an absolute value greater than that of the pilot pressure input from the control lever unit 4*a*, and therefore the proportional solenoid valve 10*b* outputs the pilot pressure input from the control lever unit 4*a* as it is. Accordingly, the boom is gradually moved down depending on the pilot pressure input from the control lever unit 4*a*.

As the boom is gradually moved down and the bucket end comes closer to the boundary L of the set area as mentioned above, the limit value c=a (<0) of the boom-dependent bucket end speed calculated in the calculating portion 9*f* is increased (its absolute value |a| or |c| is reduced) and an absolute value of the corresponding boom command limit value (<0) calculated in the calculating portion 9*h* is reduced. Then, when the absolute value of the limit value becomes smaller than the command value from the control lever unit 4*a* and the voltage output to the proportional solenoid valve 10*b* from the boom command calculating portion 9B*i* is reduced correspondingly, the proportional solenoid valve 10*b* reduces and also outputs the pilot pressure input from the control lever unit 4*a* for gradually restricting the pilot pressure applied to the hydraulic driving sector 50*b* of the flow control valve 5*a* on the boom-down side depending on the limit value c. Thus, the boom-down speed is gradually restricted as the bucket end comes closer to the boundary L of the set area, and the boom is stopped when the bucket end reaches the boundary L of the set area. As a result, the bucket end can be easily and smoothly positioned.

When the bucket end has moved out beyond the boundary L of the set area, the limit value a (=c) of the bucket end speed in proportion to the distance D to the bucket end from the boundary L of the set area is calculated as a positive value in the calculating portion 9*c* based on the relationship shown in FIG. 6, and the boom command calculating portion 9B*i* outputs a voltage corresponding to the limit value c to the proportional solenoid valve 10*a* for applying a pilot pressure corresponding to the limit value a to the hydraulic driving sector 50*a* of the flow control valve 5*a* on the boom-up side. The boom is thereby moved in the boom-up direction at a speed proportional to the distance D for restoration toward the inside of the set area, and then stopped when the bucket end is returned to the boundary L of the set area. As a result, the bucket end can be more smoothly positioned.

Further, when the control lever of the arm control lever unit 4*b* is operated in the arm-crowding direction with the intention of digging the ground toward the body, a pilot pressure representative of the command value from the control lever unit 4*b* is applied to the hydraulic driving sector 51*a* of the flow control valve 5*b* on the arm-crowding side, causing the arm to be moved down toward the body. At the same time, the pilot pressure from the control lever unit 4*b* is detected $b_y$ the pressure sensor 61*a*. The arm rotational angle detected by the angle sensor 8*b* and the pilot pressure detected by the pressure sensor 61*a* are input to the calculating portion 9B*d* which estimates an arm cylinder speed for use in control through calculation. Then, the calculating portion 9*e* estimates an arm-dependent bucket end speed b through calculation. On the other hand, the calculating portion 9*c* calculates, based on the relationship shown in FIG. 6, a limit value a (<0) of the bucket end speed in proportion to the distance D to the bucket end from the boundary L of the set area, and the calculating portion 9*f* calculates a limit value $c=a-b_y$ of the boom-dependent bucket end speed. After the calculating portion 9*g* calculates the limit value of the boom cylinder speed, the calculating portion 9B*h* determines a corresponding boom command limit value based on the flow rate characteristic of the flow control valve 5*a* which takes into consideration the load pressure of the boom cylinder 3*a*. Here, when the bucket end is so far away from the boundary L of the set area as to meet the relationship of $a<b_y$ ($|a|>|b|$), the command value c is calculated as a negative value in the calculating portion 9*f*. Therefore, the boom command calculating portion 9B*i* outputs a voltage corresponding to the limit value to the proportional solenoid valve 10*b*, thereby restricting the pilot pressure applied to the hydraulic driving sector 50*b* of the flow control value 5*a* on the boom-down side, and also outputs a voltage of 0 to the proportional solenoid valve 10*a* for making nil (0) the pilot pressure applied to the hydraulic driving sector 50*a* of the flow control valve 5*a* on the boom-up side. At this time, since the control lever unit 4*a* is not operated, no pilot pressure is supplied to the hydraulic driving sector 50*b* of the flow control valve 5*a*. As a result, the arm is gradually moved toward the body depending on the pilot pressure from the control lever unit 4*b*.

As the arm is gradually moved toward the body and the bucket end comes closer to the boundary L of the set area as mentioned above, the limit value a of the bucket end speed calculated in the calculating portion 9*c* is increased (its absolute value |a| is reduced). Then, when the limit value a becomes greater than the component $b_y$ of the arm-dependent bucket end speed b vertical to the boundary L calculated by the calculating portion 9*e*, the limit value $c=a-b_y$ of the boom-dependent bucket end speed is calculated as a positive value in the calculating portion 9*f*. Therefore, the boom command calculating portion 9B*i* outputs a voltage corresponding to the limit value c to the proportional solenoid valve 10*a* on the boom-up side, thereby restricting the pilot pressure applied to the hydraulic driving sector 50*a* of the flow control valve 5*a* to that limit value, and also outputs a voltage of 0 to the proportional solenoid valve 10*b* on the boom-down side for making nil (0) the pilot pressure applied to the hydraulic driving sector 50*b* of the flow control valve 5*a*. Accordingly, the boom-up operation for modifying the bucket end speed is performed such that the component of the bucket end speed vertical to the boundary L is gradually restricted in proportion to the distance D to the bucket end from the boundary L. Thus, direction change control is carried out with a resultant of the unmodified component b, of the arm-dependent bucket end speed parallel to the boundary L and the speed component vertical to the boundary L modified depending on the limit value c, as shown in FIG. 10, enabling the excavation to be performed along the boundary L of the set area.

Further, when the bucket end has moved out beyond the boundary L of the set area, the limit value a of the bucket end speed in proportion to the distance D to the bucket end from the boundary L of the set area is calculated as a positive value in the calculating portion 9*c* based on the relationship shown in FIG. 6, the limit value $c=a-b_y$ (>0) of the boom-dependent bucket end speed calculated in the calculating portion 9*f* is increased in proportion to the limit value a, and the voltage output from the boom command calculating portion 9*i* to the proportional solenoid valve 10*a* on the boom-up side is increased depending on the limit value c. In the case of the bucket end going out of the set area, therefore, the boom-up operation for modifying the bucket end speed is performed so that the bucket end is restored toward the inside of the set area at a speed proportional to the distance D. Thus, the excavation is carried out under a combination of the unmodified component $b_x$ of the arm-dependent bucket end speed parallel to the boundary L and the speed component vertical to the boundary L modified depending on the limit value c, while the bucket end is gradually returned to and moved along the boundary L of the set area as shown in FIG. 11. Consequently, the excavation can be smoothly performed along the boundary L of the set area just by crowding the arm.

With this embodiment, as described above, similar advantages as with the first embodiment can be obtained in the control system wherein the control lever units of hydraulic pilot means are employed as operating means.

A third embodiment of the present invention will be described with reference to FIGS. 14 to 33. In this embodiment, the present invention is applied to area limiting excavation control different from that employed in the first embodiment. In FIGS. 14 to 33, equivalent members to those in FIG. 1 are denoted by the same reference numerals.

Figure 14:
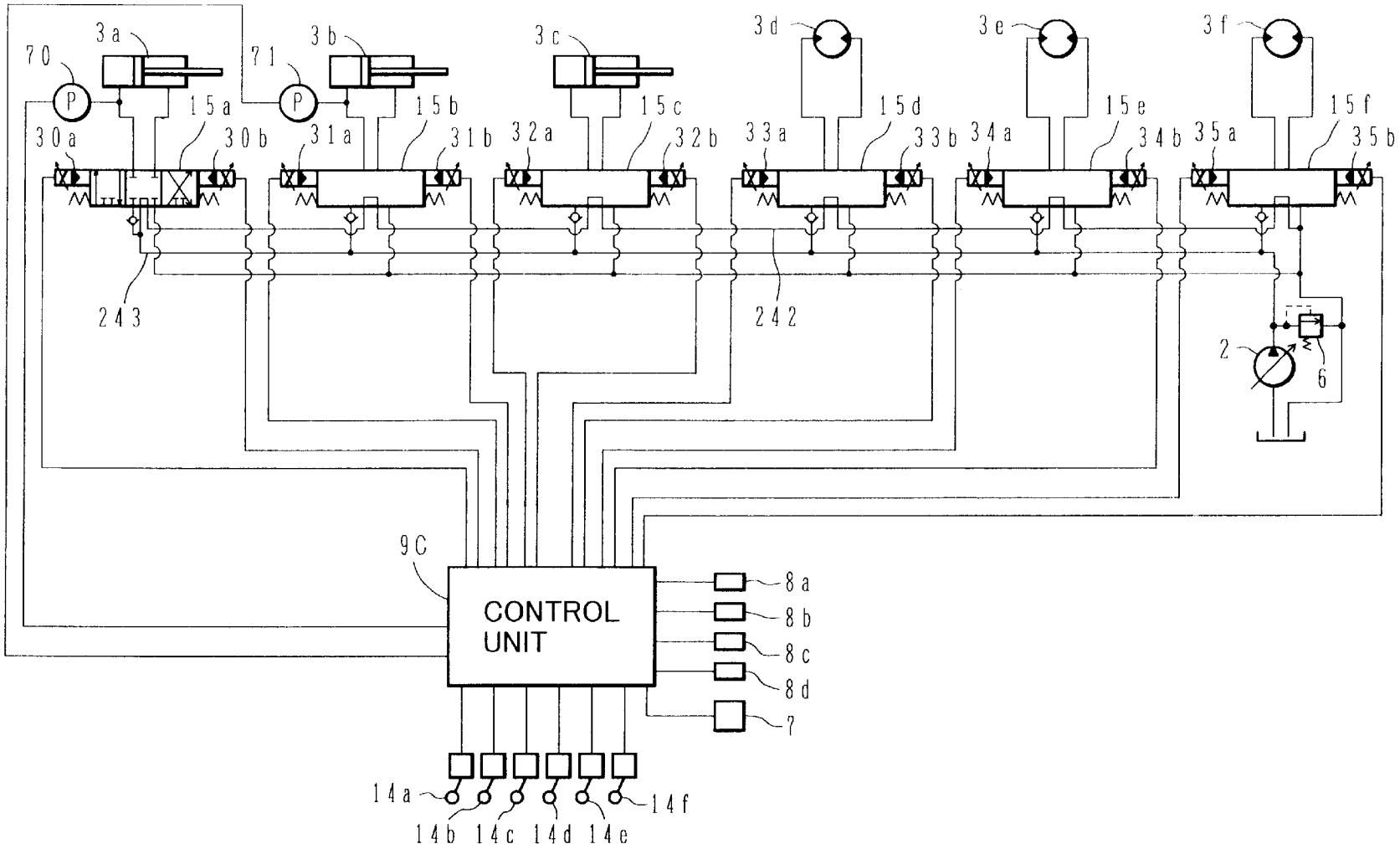
FIG. 14 is a diagram showing a front control system (area limiting excavation control system) for a construction machine according to a third embodiment of the present invention, along with a hydraulic drive system thereof.

Referring to FIG. 14, an area limiting excavation control system of this embodiment includes, in addition to the pressure sensor 70 for detecting the load pressure of the boom cylinder 3*a* on the bottom side in the boom-up direction, a pressure sensor 71 for detecting the load pressure of the arm cylinder 3*b* on the bottom side in the arm-crowding direction, both detection signals from these pressure sensors being input to a control unit 9C.

The control unit 9C includes an area setting section and an area limiting excavation control section. The area setting section executes, in accordance with an instruction from the setting device 7, calculation for setting the excavation area where the end of the bucket 1*c* is allowed to move. One example of a manner of setting the excavation area has been described in connection with the first embodiment, and hence the description is not repeated.

Figure 15:
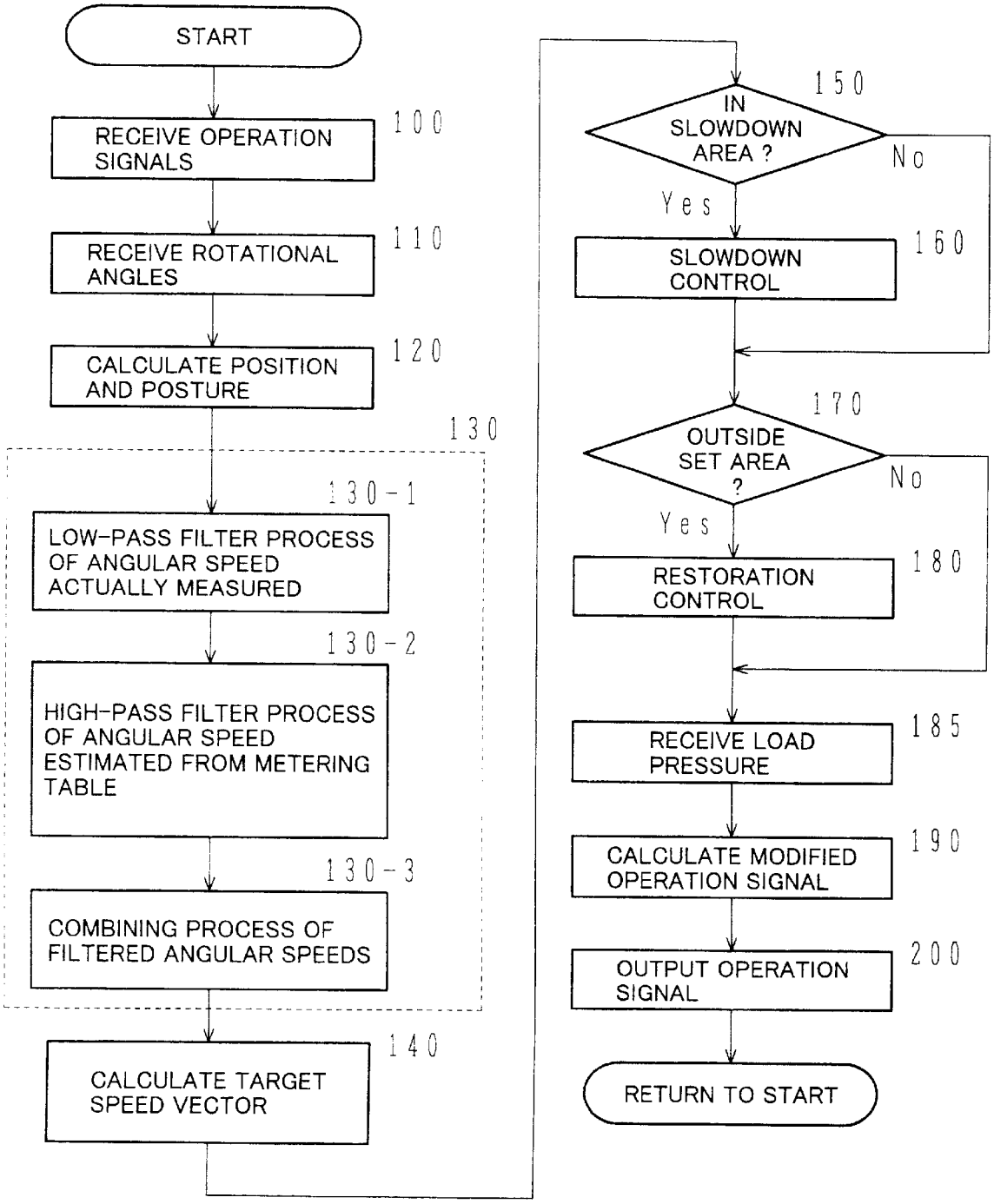
FIG. 15 is a flowchart showing control steps executed in a control unit.

The area limiting excavation control section in the control unit 9C executes control for limiting the area where the front device 1A is allowed to move, following processes shown in a flowchart of FIG. 15. A description will now be made on the operation of this embodiment while explaining control functions of the area limiting excavation control section with reference to the flowchart of FIG. 15.

First, operation signals from the control lever units 14*a*–14*f* are input in step 100, and rotational angles α, β, γ of the boom 1*a*, the arm 1*b* and the bucket 1*c* detected by the angle sensors 8*a*, 8*b*, 8*c* are input in step 110.

Then, in step 120, the position and posture of the front device 1A are calculated based on the detected rotational angles α, β, γ and the various dimensions of the front device 1A which are stored beforehand, thereby calculating the position of a predetermined part of the front device 1A, e.g., the end position of the bucket 1*c*. At this time, similarly to the process executed in the area setting section for calculating the bucket end position, the end position of the bucket 1*c* is first calculated as values on the XY-coordinate system, and these values on the XY-coordinate system are then transformed into values on the XaYa-coordinate system.

Next, in step 130, a boom cylinder speed, an arm cylinder speed and a bucket cylinder speed all for use in control are estimated by taking the respective sums of low-frequency components of the rotational angles of the boom, the arm and the bucket detected by the angle sensors 8*a*, 8*b*, 8*c*, and high-frequency components of angular speeds of the boom, the arm and the bucket in accordance with the operation signals from the control lever units 14*a*, 14*b*, 14*c*.

Processing procedures executed in step 130 will now be described in sequence of steps 130-1 to 130-3. Note that the following description will be made on a process of only the arm angular speed for the simplicity of explanation.

Figure 16:
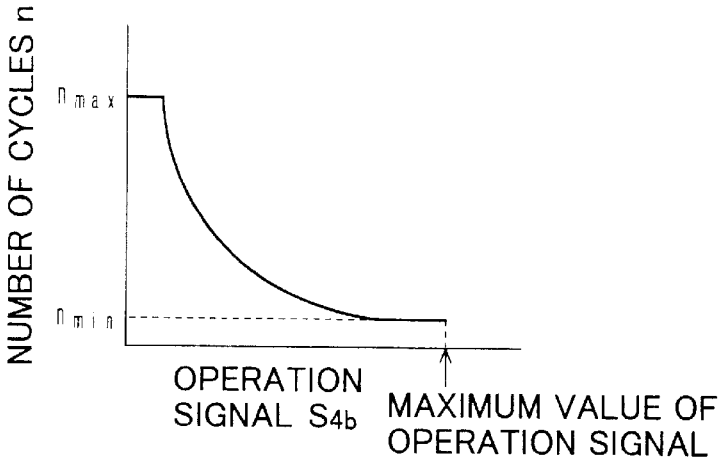
FIG. 16 is a graph showing the relationship between an arm operation signal and the number of calculation cycles for deciding how many cycles should go back from a current value to determine an output value of an angle sensor that is to be used.
Figure 17:
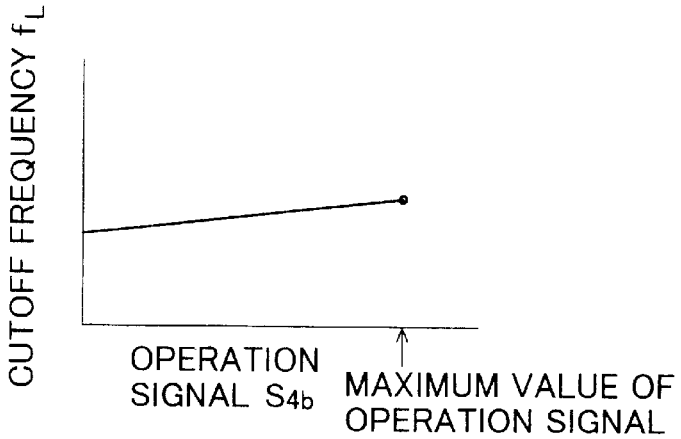
FIG. 17 is a graph showing the relationship between the arm operation signal and a cutoff frequency in a low-pass filter process.

First, in step 130-1, based on an operation signal $S_{4b}$ from the arm control lever unit 14*b* and a preset table representing the relationship between the operation signal $S_{4b}$ and the number of calculation cycles for an output value of the angle sensor 8*b*, as shown in FIG. 16, the control unit 9C finds the number n of calculation cycles corresponding to the magnitude of the arm operation signal $S_{4b}$ and decides how many cycles should go back from a current value for determining the output value of the angle sensor 8*b* that is to be used. The output values of the angle sensor 8*b* covering n number of cycles, including the current value, are stored in a temporary memory (RAM) of the control unit 9C. Then, an actual angular speed $\Omega_1$ of the arm is calculated from the output value of the angle sensor 8*b* before n cycles, following the formula below:

$$\Omega_1=(\alpha_a-\alpha_{a-n})/(T\times n)$$

n: number of cycles $\alpha_a$: current output of the angle sensor $\alpha_{a-n}$: output of the angle sensor before n cycles T: period of one cycle Next, to eliminate the effect of a delay in signal rising with respect to the calculated actual angular speed $\Omega_1$ of the arm and to remove noise contained in the signal, a low-pass filter process is performed on the actual angular speed $\Omega_1$. At this time, the cutoff frequency in the low-pass filter process is determined below. A table representing the relationship between the operation signal $S_{4b}$ and the cutoff frequency of a low-pass filter, as shown in FIG. 17, is prepared beforehand. A cutoff frequency $f_L$ corresponding to the magnitude of the arm operation signal $S_{4b}$ from the arm control lever units 14*b* is calculated from the table, and the low-pass filter process is performed on the actual angular speed $\Omega_1$ by using the cutoff frequency $f_L$. A resulted value (i.e., low-frequency component) is expressed by $\Omega_{11}$.

Figure 18:
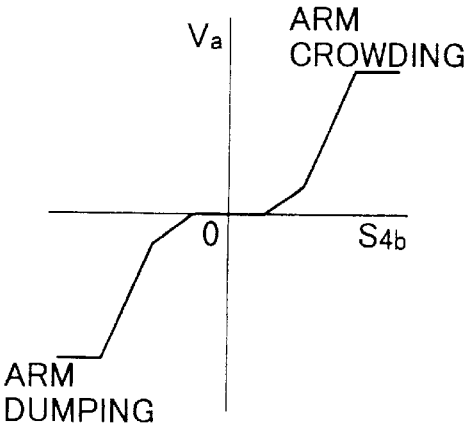
FIG. 18 is a graph showing the relationship between the arm operation signal and the arm cylinder speed.

Subsequently, in step 130-2, based on the operation signal $S_{4b}$ from the arm control lever unit 14*b* and a preset metering table representing the relationship between the operation signal $S_{4b}$ and an arm cylinder speed Va derived operation signal $S_{4b}$ and an arm cylinder speed Va derived from the flow control valve 15*b*, as shown in FIG. 18, the control unit 9C calculates the arm cylinder speed Va corresponding to the magnitude of the operation signal $S_{4b}$. Then, the arm cylinder speed Va is converted into a commanded angular speed $\Omega_2$ of the arm, following the formula below:

$$\Omega_2=-Sa\times Va/(L_4L_5\sin(\pi-\beta-\alpha_2-\beta_2))$$

$$Sa=\sqrt{(L_4^2+L_5^2-2L_4L_5\cos(\pi-\beta-\alpha_2-\beta_2))}$$

Figure 19:
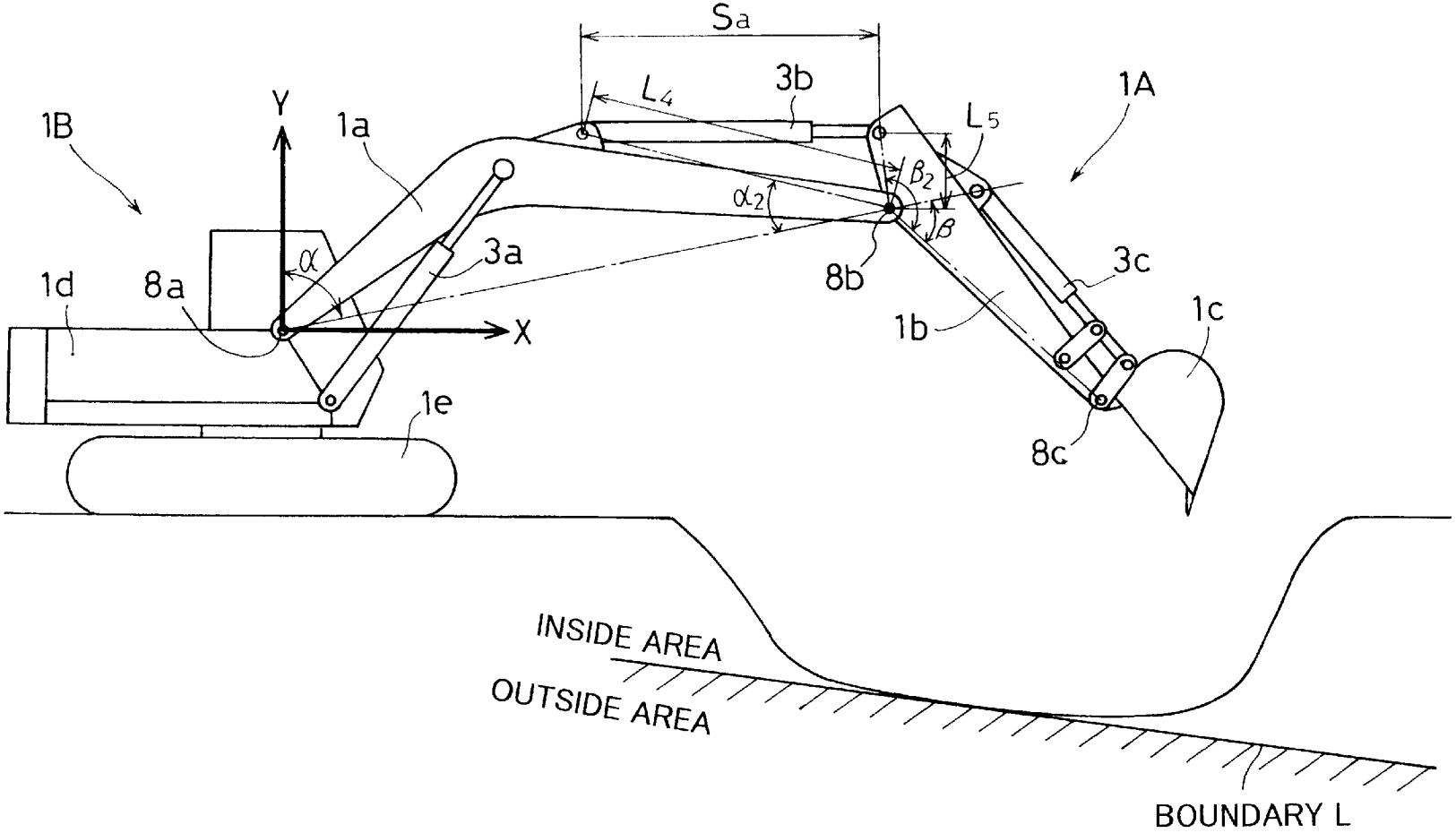
FIG. 19 is a view showing various dimensions for use in calculating a commanded angular speed for an arm from the arm operation signal.

Sa: length of the arm cylinder $L_4$: distance between base end of the arm cylinder and fore end of the boom (see FIG. 19)

$L_5$: distance between fore end of the arm cylinder and fore end of the boom (see FIG. 19)

$\alpha_2$: angle formed between straight line connecting the boom base end and the boom fore end and straight line connecting the arm cylinder base end and the boom fore end (see FIG. 19)

$\beta$: angle formed between straight line connecting the boom base end and the boom fore end and straight line connecting the boom fore end and fore end of the arm (see FIG. 19) $\beta_2$: angle formed between straight line connecting the boom fore end and the arm cylinder fore end and straight line connecting the boom fore end and the arm fore end (see FIG. 19)

Figure 20:
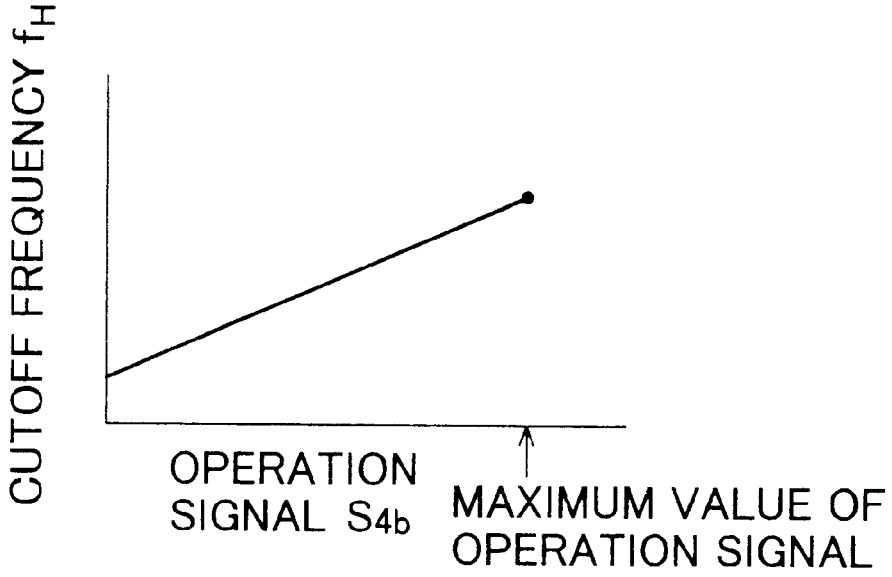
FIG. 20 is a graph showing the relationship between the arm operation signal and a cutoff frequency in a high-pass filter process.

Next, a cutoff frequency $f_H$ corresponding to the magnitude of the operation signal $S_{4b}$ is calculated from a operation signal $S_{4b}$ and the cutoff frequency of a high-pass filter, as shown in FIG. 20. A high-pass filter process is then performed on the commanded angular speed $\Omega_2$ by using the cutoff frequency $f_H$. A resulted value (i.e., high-frequency component) is expressed by $\Omega_{2h}$.

After that, in step 130-3, the high-frequency component $\Omega_{2h}$ is of the commanded angular speed is first multiplied by a gain k, and the resulted product is added to the low-frequency component $\Omega_{11}$ is of the actual angular speed calculated in step 130-1, thereby calculating an arm angular speed $\Omega_a$ for use in control. Thus:

$$\Omega_a=\Omega_{11}+k\Omega_{2h}$$

Now, a description will be made on the reason why the number n of cycles should be determined corresponding to the magnitude of the operation signal $S_{4b}$ from the table shown in FIG. 16, when calculating the actual angular speed $\Omega_1$ of the arm as mentioned above.

(1) In the case of calculating an arm angular speed from the output value of the arm angle sensor 8*b*, if hardware is made of;

angle sensor 8*b* . . . potentiometer outputting 0–5 V through rotation of 180°, and A/D-converter . . . converting 0–5 V into digital value of 10 bits (with resolution of 1024), an angle resolution dθ per digit resulted from the A/D-conversion made on the above condition is given by:

$$d\theta=180/1024=0.176°/\text{digit} \quad (1)$$

(2) An angular speed is calculated by dividing change (difference) in angle over a certain period of time t by t. Assuming here that the angular speed is 40°/sec, the period of angle calculation is 10 msec, and the number of cycles used for calculation of the angular speed is 5, a value of angle change detected for 5 cycles is below:

$$(4°/\text{sec}/0.176°/\text{digit})\times(5\times10\ \text{msec})=11\ \text{digit} \quad (2)$$

(the figure below first place of decimals is omitted because an A/D-conversion value is an integer)

Conversely, taking into account that the change in angle over 5 cycles (50 msec) is 11 digit, the angular speed is calculated below from that result:

$$(11\ \text{digit}\times0.176°/\text{digit})/50\ \text{msec}=38.72°/\text{sec} \quad (3)$$

There is an error between the above calculated value and the correct value of 40°/sec. As will be seen from the formula (2), the error is attributable to that because an A/D-conversion value is an integer, the resulted value always contains an error on the order of ±0.5 digit (quantization error). Such an error can be reduced by increasing the number of cycles for use in calculation of the angular speed so that the effect of quantization error is diminished. By selecting the number of cycles to, e.g., 20, in the above example, the angle change detected for 20 cycles is given by:

$$(40°/\text{sec}/0.176°/\text{digit})\times(20\times10\ \text{msec})=45\ \text{digit} \quad (4)$$

From this, the angular speed is conversely calculated as follows:

$$(45\ \text{digit}\times0.176°/\text{digit})/200\ \text{msec}=39.6°/\text{sec} \quad (5)$$

Thus, the accuracy in calculating the angular speed is improved as compared with the formula (3). Also, if the A/D-conversion value contains an error on the order of ±1 digit due to the effect of noise, etc., an effect upon the resulted angular speed is below when the number of cycles is selected to 5:

$$((11+1)\times 0.176°/\text{digit})/50\ \text{msec}=42.2°/\text{sec}$$

$$((11-1)\times 0.176°/\text{digit})/50\ \text{msec}=35.2°/\text{sec} \quad (6)$$

Thus, the effect gives rise to an error ranging from +2.2 to −4.8°/sec. On the contrary, when the number of cycles is selected to 20, an effect upon the resulted angular speed is below:

$$((45+1)\times 0.176°/\text{digit})/200\ \text{msec}=40.5°/\text{sec}$$

$$((45-1)\times 0.176°/\text{digit})/200\ \text{msec}=38.7°/\text{sec} \quad (7)$$

Thus, the effect gives rise to a smaller error ranging from +0.5 to −1.3°/sec than when the number of cycles is selected to 5.

Accordingly, a relationship between an angular speed Ω to be detected (corresponding to the above $\Omega_1$) and an appropriate number n of cycles for calculating the actual angular speed is below:

$$n\times\Omega=\text{constant} \quad (8)$$

Figure 21:
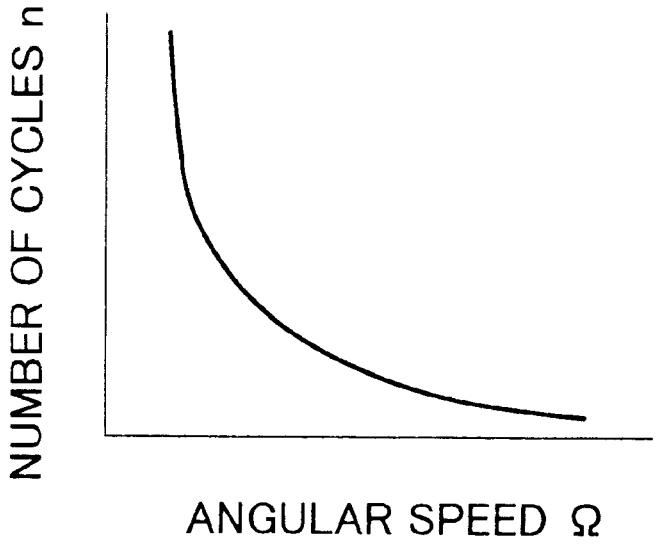
FIG. 21 is a graph showing the relationship between an angular speed to be detected and an adequate value n of calculation cycles of the angular speed.

This relationship is plotted as shown in FIG. 21.

(3) In practical calculation, since the angular speed Ω is not known, a control lever signal S (corresponding to the above $S_{4b}$) which is almost in proportion to Ω is used instead of Ω.

Also, since the number n of calculation cycles cannot be set to be infinite, a certain upper limit value $n_{max}$ is decided. Further, since Ω takes a maximum value $\Omega_{max}$, an operation signal corresponding to $\Omega_{max}$ is expressed by $S_{max}$. Taking into account those conditions, the plot of FIG. 21 is modified as shown in FIG. 16.

As described above, when the actual angular speed $\Omega_1$ of the arm is calculated by differentiating the output from the angle sensor, the accuracy in calculating the angular speed depends on how many cycles go back from a current value to determine the output value from the angle sensor that is to be used for the differentiation. In other words, that accuracy can be kept substantially constant by making the differentiation using the output value before a relatively large number of cycles when the magnitude of the operation signal $S_{4b}$ is small, and by making the differentiation using the output value before a relatively small number of cycles when the magnitude of the operation signal $S_{4b}$ is large.

Next, a description will be made on the reasons why the cutoff frequency $f_H$ is determined corresponding to the magnitude of the operation signal $S_{4b}$ from the table shown in FIG. 20 and the high-frequency component $\Omega_{2h}$ of the commanded angular speed is multiplied by the gain k, when the high-pass filter process is conducted on the commanded angular speed $\Omega_2$.

Figure 22:
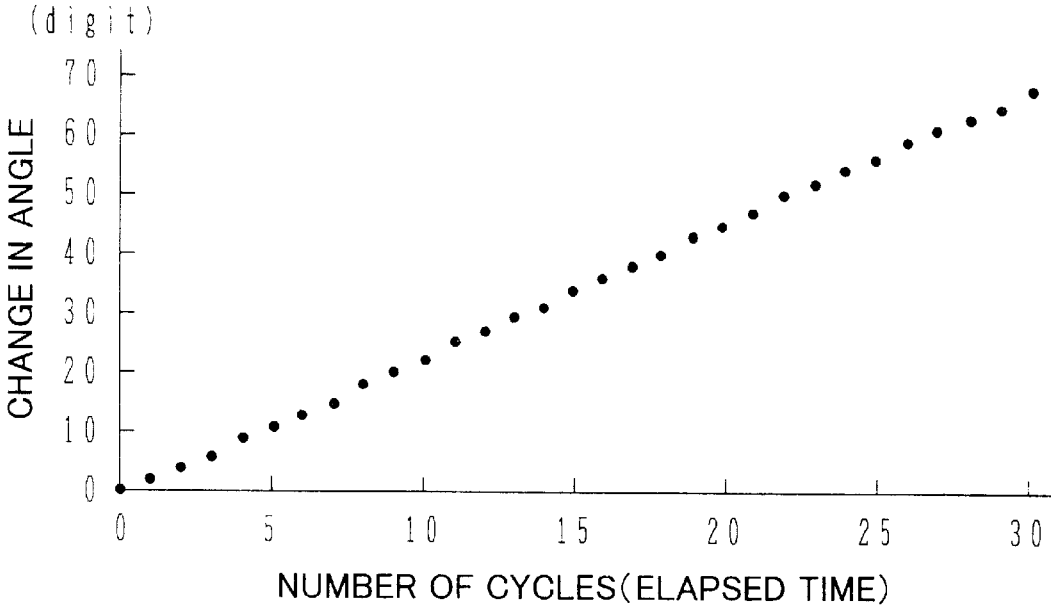
FIG. 22 is a graph showing change in the arm angle detected after an arm has started to move.

(1) Assuming here that the angular speed is 40°/sec, the number n of calculation cycles is 20, and the period of angle detection is 10 msec, change in the arm rotational angle is detected as shown in FIG. 22 after the arm has begun to move.

1st cycle: 40°/sec×10 msec×(1/0.176°/digit)=2 digit

2nd cycle: 40°/sec×20 msec×(1/0.176°/digit)=4 digit

3rd cycle: 40°/sec×30 msec×(1/0.176°/digit)=6 digit

4th cycle: 40°/sec×40 msec×(1/0.176°/digit)=9 digit

Figure 23:
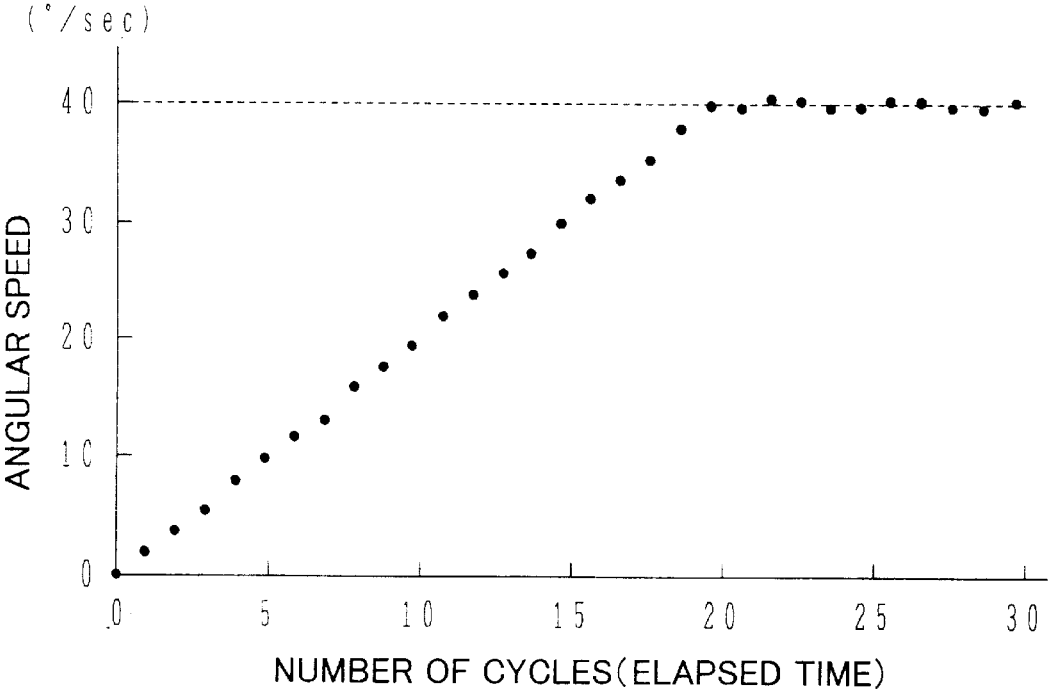
FIG. 23 is a graph showing an angular speed calculated from the calculation result shown in FIG. 22.

From the above calculation results, the angular speed is calculated below for each cycle because the angular speed before 20 cycles for use in calculation is 0 until the 20th cycle and the angular speed before 20 cycles for use in calculation is given as 2 digit only when reaching the 21st cycle:

1st cycle: (angle change in 1st cycle—angle before 20 cycles)/200 msec×0.176°=1.8°/sec 2nd cycle: (angle change in 2nd cycle—angle before 20 cycles)/200 msec×0.176°=3.5°/sec 3rd cycle: (angle change in 3rd cycle—angle before 20 cycles)/200 msec×0.176°=5.3°/sec 20th cycle: (angle change in 20th cycle—angle before 20 cycles)/200 msec×0.176°=39.6°/sec 21st cycle: (angle change in 21st cycle—angle before 20 cycles)/200 msec×0.176°=39.6°/sec In this way, as shown in FIG. 23, a correct value can be calculated only after 20 calculation cycles have elapsed. Thus, the angular speed is calculated as shown in FIG. 24A when the number of calculation cycles is small (when the operation signal $S_{4b}$ is large), and is calculated as shown in FIG. 24B when the number of calculation cycles is large (when the operation signal $S_{4b}$ is small).

(2) For the result calculated as explained above, an error attributable to the time ($n_1$ or $n_2$) until reaching the correct angular speed after rising at the start of measurement is compensated as follows. The table representing the relationship between the operation signal $S_{4b}$ and the arm cylinder speed Va, as shown in FIG. 18, is prepared beforehand. The commanded angular speed $\Omega_2$ is then calculated from Va corresponding to $S_{4b}$. The high-pass filter process is performed on the commanded angular speed $\Omega_2$ while changing the cutoff frequency $f_H$ as plotted in FIG. 25. Cutoff frequency characteristics shown in FIG. 25 are selected to be suitable for compensating the errors in the output value of the angle sensor occurred at the time of rising as shown in FIGS. 24A and 24B.

Figure 24A:
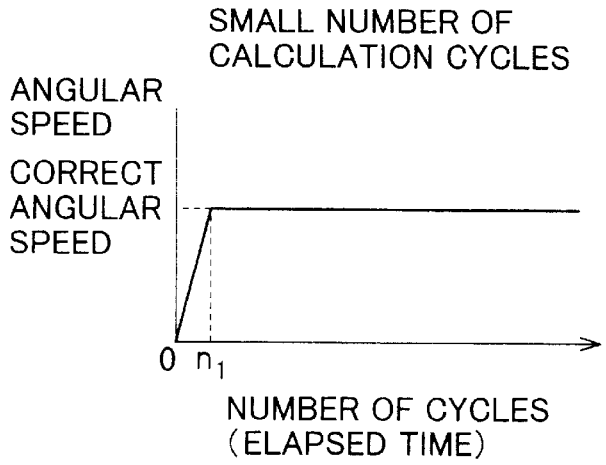
FIGS. 24A and 24B are graphs showing a difference in angular speed between the case where the number of calculation cycles is small and the case where it is large.
Figure 25:
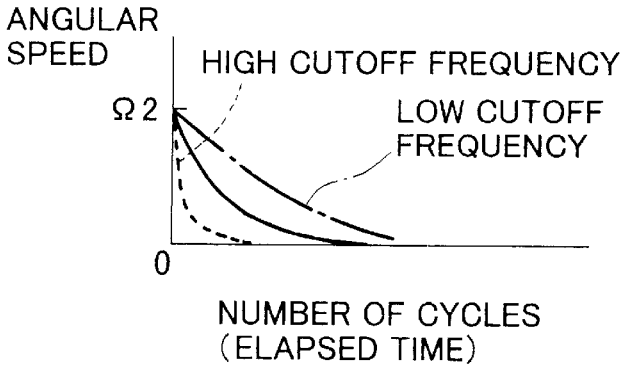
FIG. 25 is a graph showing characteristics resulted when the high-pass filter process is performed while the cutoff frequency is changed with respect to the commanded angular speed.
Figure 26:
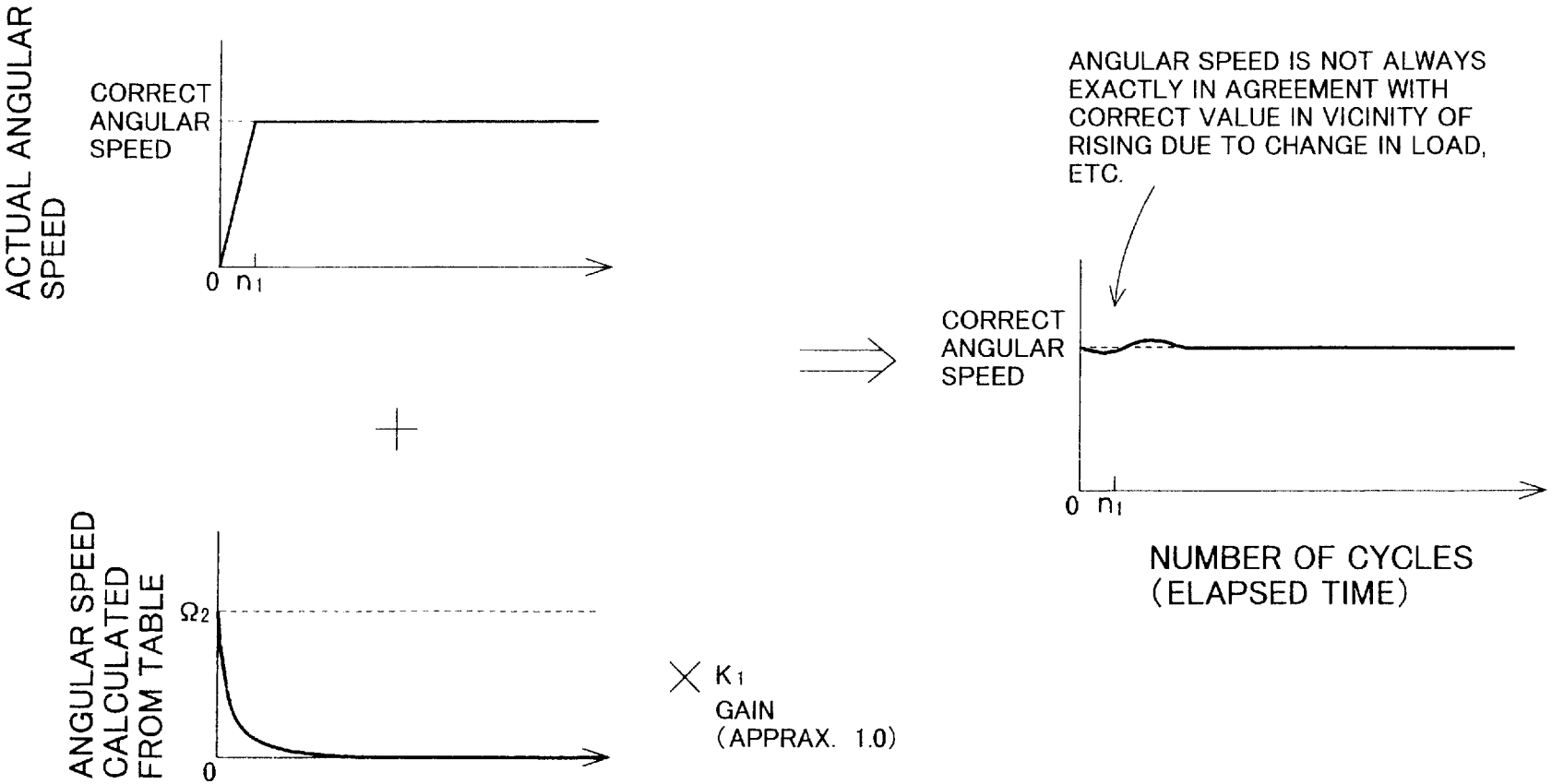
FIG. 26 is a graph showing a process of compositely producing a correct angular speed when the number of calculation cycles is small.

Specifically, in the case of FIG. 24A where the number of calculation cycles is small (where the operation signal $S_{4b}$ is large), the high-pass filter process with a higher cutoff frequency is performed on the commanded angular speed $\Omega_2$, the resulted value is multiplied by an appropriate gain $k_1$, and the resulted product is added to the actual angular speed $\Omega_1$, as shown in FIG. 26. As a result, an angular speed close to the correct value can be obtained even at the time of rising.

Figure 24B:
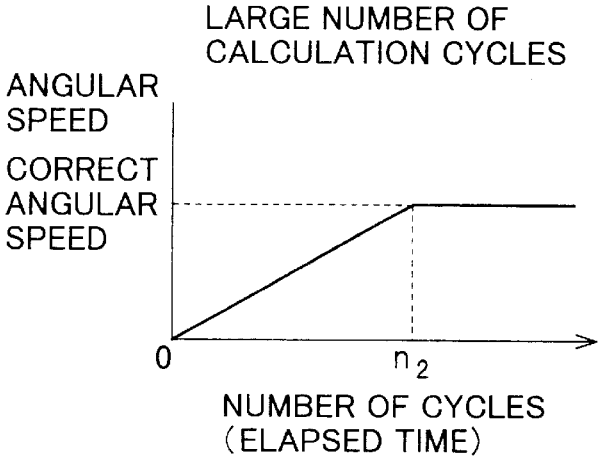
Figure 27:
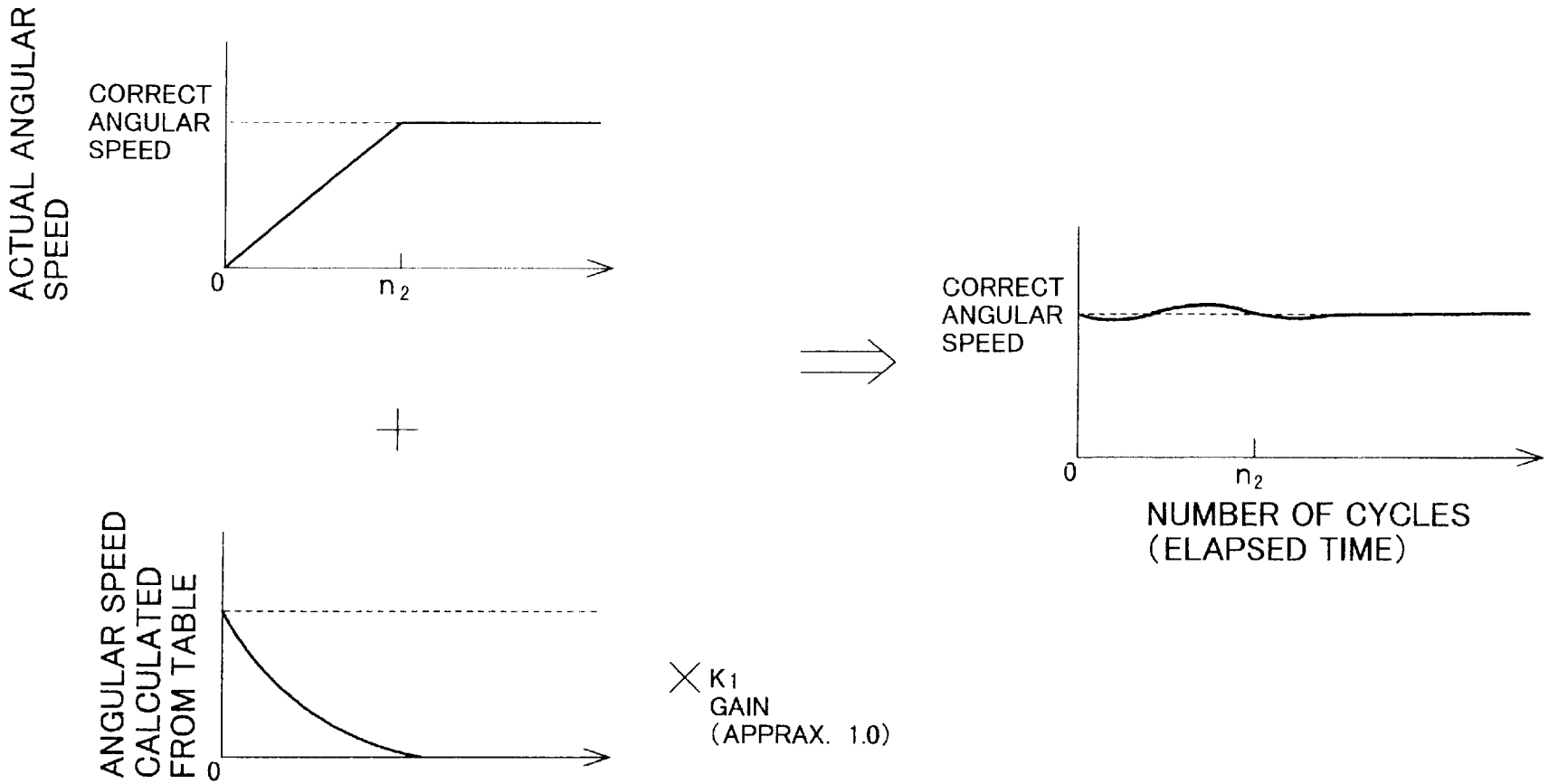
FIG. 27 is a graph showing a process of compositely producing a correct angular speed when the number of calculation cycles is large.

On the other hand, in the case of FIG. 24B where the number of calculation cycles is large (where the operation signal $S_{4b}$ is small), the high-pass filter process with a lower cutoff frequency is performed on the commanded angular speed $\Omega_2$, the resulted value is multiplied by an appropriate gain $k_2$, and the resulted product is added to the actual angular speed $\Omega_1$, as shown in FIG. 27. As a result, an angular speed close to the correct value can be obtained even at the time of rising.

Figure 28:
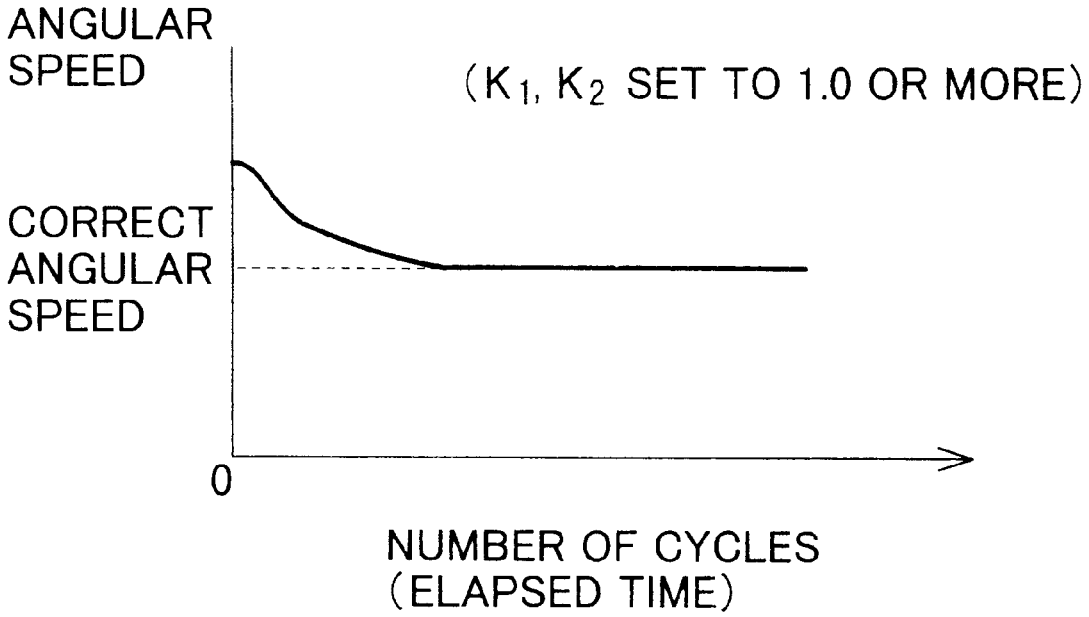
FIG. 28 is a graph showing the effect resulted from multiplying the commanded angular speed by a gain k not less than one (1) when the actual angular speed and the commanded angular speed are combined with each other.

(6) In the control process of this embodiment, a boom cylinder target speed is finally calculated from the arm angular speed, and it is expected that the boom has so large inertia as to cause a delay in response at the time of rising. To compensate such a response delay of the boom, therefore, the arm angular speed is calculated to have an overly estimated value at the time of rising, as shown in FIG. 28, by setting the gains $k_1$, $k_2$ to relatively large values. As a result, the boom target speed is also calculated to be relatively large at the time of rising, and the effect of compensating the response delay is achieved. This effect is essentially the same as achieved with differentiation control.

Of the angular speed components calculated through the foregoing process of step 130, since the low-frequency component $\Omega_{11}$ represents an actually measured value resulted from differentiating the output of the angle sensor, it is not affected by the load imposed upon the front device, the fluid temperature, etc. and hence can be calculated with high accuracy. Also, while the accuracy in calculating the angular speed depends on how many cycles go back from a current value to determine the output value from the angle sensor that is to be used for the differentiation, it is possible, as stated above, to keep the accuracy substantially constant by making the differentiation using the output value before a relatively large number of cycles when the magnitude of the operation signal $S_{4b}$ is small, and by making the differentiation using the output value before a relatively small number of cycles when the magnitude of the operation signal $S_{4b}$ is large.

Further, the high-pass filter process is performed on the commanded angular speed with a relatively low cutoff frequency when the magnitude of the operation signal $S_{4b}$ is small, and with a relatively high cutoff frequency when the magnitude of the operation signal $S_{4b}$ is large, and the filter-processed value is combined with the actual angular speed to estimate an angular speed for use in control. Therefore, a detection error that occurs at the time of rising of the output from the angle sensor depending on the magnitude of the operation signal is compensated, and an angular speed close to the correct value is obtained even at the time of rising.

Moreover, by appropriately selecting the gain k to be multiplied by the high-frequency component $\Omega_{2h}$ of the commanded angular speed, the compensation for a delay at the time of signal rising can be set to an optimum degree.

Note that an angular speed for use in control can be similarly calculated for any of other members such as the boom, and hence the description is not repeated.

Next, in step 140, a target speed vector Vc at the bucket end is calculated based on the angular speeds of the front members calculated in step 130 and the various dimensions of the front device 1A. The target speed vector Vc is first calculated as values on the XY-coordinate system. Those values are then converted into values on the XaYa-coordinate system by using the transform data from the XY-coordinate system into the XaYa-coordinate system that has been derived before, thus determining a vector component Vcx of the target speed vector Vc in the direction parallel to the boundary of the set area and a vector component Vcy of the target speed vector Vc in the direction vertical to the boundary of the set area. Here, the Xa-coordinate component Vcx of the target speed vector Vc on the XaYa-coordinate system represents a vector component of the target speed vector Vc in the direction parallel to the boundary of the set area, and the Ya-coordinate component Vcy represents a vector component of the target speed vector Vc in the direction vertical to the boundary of the set area.

Figure 29:
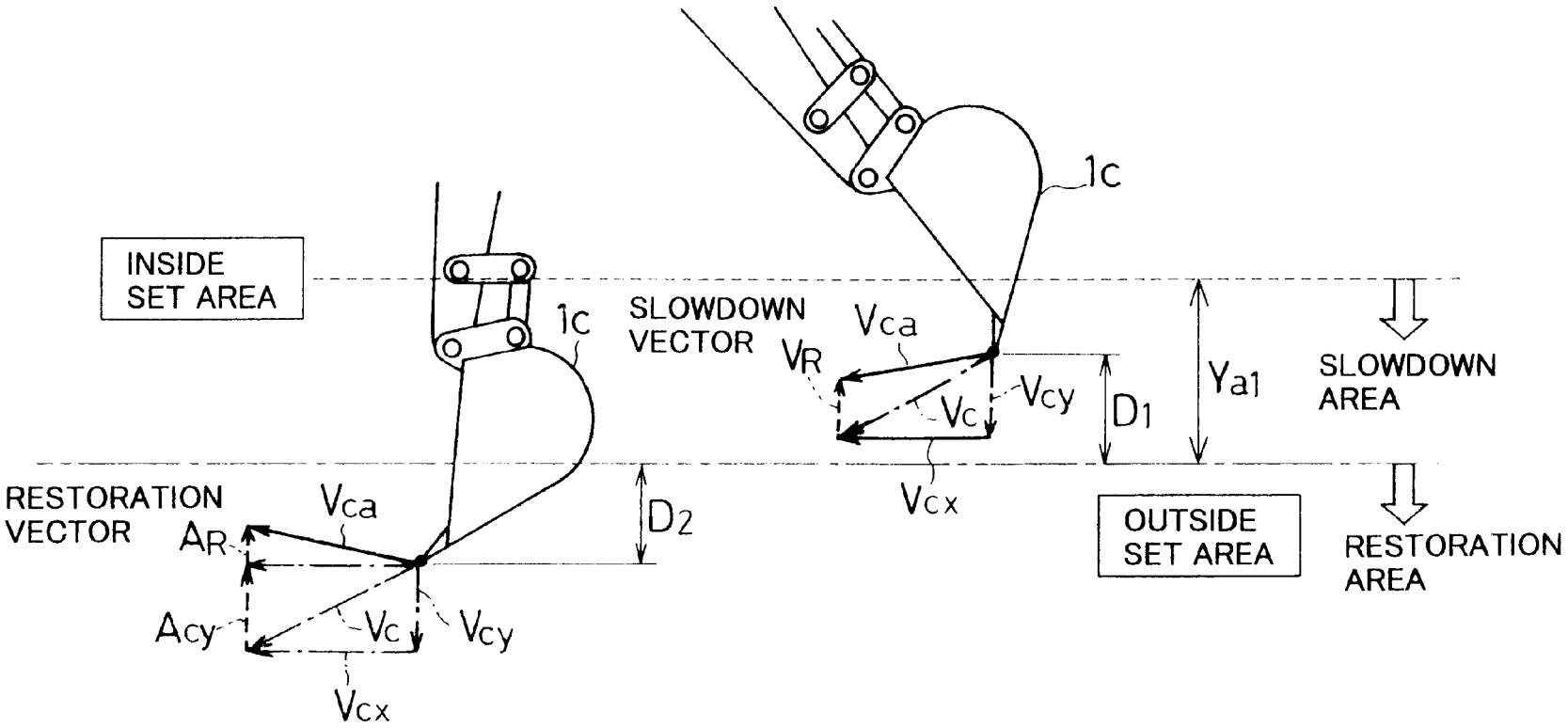
FIG. 29 is an illustrative view showing a manner of modifying a target speed vector in a slowdown area and a restoration area in this embodiment.

Then, in step 150, it is determined whether or not the end of the bucket 1*c* is in a slowdown area defined inside the set area and adjacent the boundary, shown in FIG. 29, which has been set as described before. If the end of the bucket 1*c* is in the slowdown area, the process flow goes to step 160 where the target speed vector Vc is modified so as to slow down the front device 1A. If the end of the bucket 1*c* is not in the slowdown area, the process flow goes to step 170.

Then, in step 170, it is determined whether or not the end of the bucket 1*c* is outside the set area, shown in FIG. 29, which has been set as described before. If the end of the bucket 1*c* is outside the set area, the process flow goes to step 180 where the target speed vector Vc is modified so as to return the end of the bucket 1*c* to the set area. If the end of the bucket 1*c* is not outside the set area, the process flow goes to step 185.

Then, in step 185, the control unit receives the load pressures of the boom cylinder 3*a* and the arm cylinder 3*b* detected by the pressure sensors 70, 71, respectively.

Then, in step 190, angular speeds of the front members corresponding to the modified target vector Vc obtained in step 160 or 180 are determined based on the respective load pressures of the boom cylinder 3*a* and the arm cylinder 3*b* detected by the pressure sensors 70, 71 and the flow rate characteristics of the flow control valves 15*a*, 15*b* which take the load pressures into consideration as with the flow rate characteristic shown in FIG. 9. Further, operation signals of the flow control valves 5*a*–5*c* are calculated. These calculation processes are a reversal of the process of calculating the angular speeds in step 130 and the process of calculating the target speed vector Vc in step 140. By thus conducting load compensation upon the operation signals of the flow control valves for the boom and arm when they are determined, the control can be performed while being less affected by load variations.

After that, the operation signals received in step 100 or the operation signals calculated in step 190 are output in step 200, followed by returning to the start.

The determination in step 150 as to whether or not the bucket end is in the slowdown area, and the manner of modifying the operation signals in step 160 when the bucket end is in the slowdown area, will now be described with reference to FIGS. 30 and 31.

Figure 30:
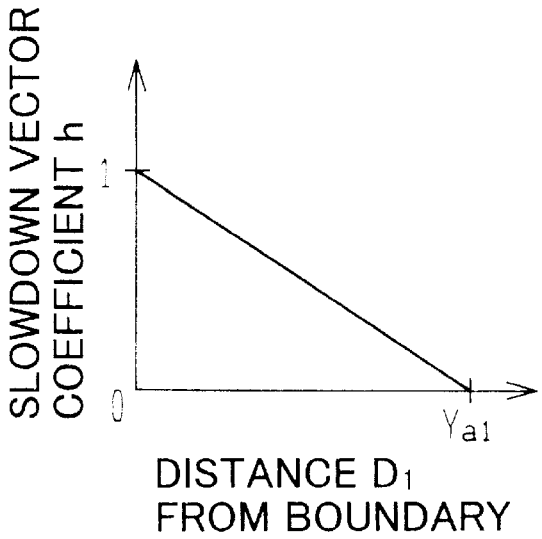
FIG. 30 is a graph showing the relationship between the distance to the bucket end from the boundary of the set area and a slowdown vector coefficient.

The memory of the control unit 9C also stores the relationship between a distance D1 to the end of the bucket 1*c* locating inside the set area from the boundary of the set area and a slowdown vector coefficient h, as shown in FIG. 30. The relationship between the distance D1 and the coefficient h is set such that the coefficient h is equal to 0 (h=0) when the distance D1 is larger than a distance Ya1, is gradually increased as the distance D1 decreases when D1 is smaller than Ya1, and is equal to 1 (h=1) at the distance D1=0. Here, an area defined adjacent the boundary of the set area and covered by the distance Ya1 measured into the inside of the set area corresponds to the slowdown area. In step 150, the control unit determines that the bucket end has entered the slowdown area, when the position of the bucket end is converted into values on the XaYa-coordinate system by using the aforesaid transform data from the XY-coordinate system into the XaYa-coordinate system, the resulting Ya-coordinate value is taken as the distance D1, and the distance D1 (Ya-coordinate value) becomes smaller than the distance Ya1.

Also, in step 160, the target speed vector Vc is modified so as to reduce the vector component of the target speed vector Vc at the end of the bucket 1*c* calculated in step 140 in the direction toward the boundary of the set area, that is equivalent to the vector component thereof vertical to the boundary of the set area, i.e., the Ya-coordinate component Vcy on the XaYa-coordinate system. More specifically, the slowdown vector coefficient h corresponding to the distance D1 to the end of the bucket 1*c* from the boundary of the set area at that time is calculated from the relationship, shown in FIG. 30, stored in the memory of the control unit. The Ya-coordinate value (vertical vector component) Vcy of the target speed vector Vc is multiplied by the calculated slowdown vector coefficient h and further multiplied by −1 to obtain a slowdown vector $V_R$ (=−h·Vcy). $V_R$ is then added to Vcy. Here, the slowdown vector $V_R$ is a speed vector which orients in opposed relation to Vcy and which is gradually increased as the distance D1 to the end of the bucket 1*c* from the boundary of the set area decreases from Ya1 and then becomes equal to −Vcy ($V_R$=−Vcy) at D1=0. By adding the slowdown vector $V_R$ to the vertical vector component Vcy of the target speed vector Vc, therefore, the vertical vector component Vcy is reduced such that an amount of reduction in the vertical vector component Vcy is gradually increased as the distance D1 decreases from Ya1. As a result, the target speed vector Vc is modified into a target speed vector Vca.

Figure 31:
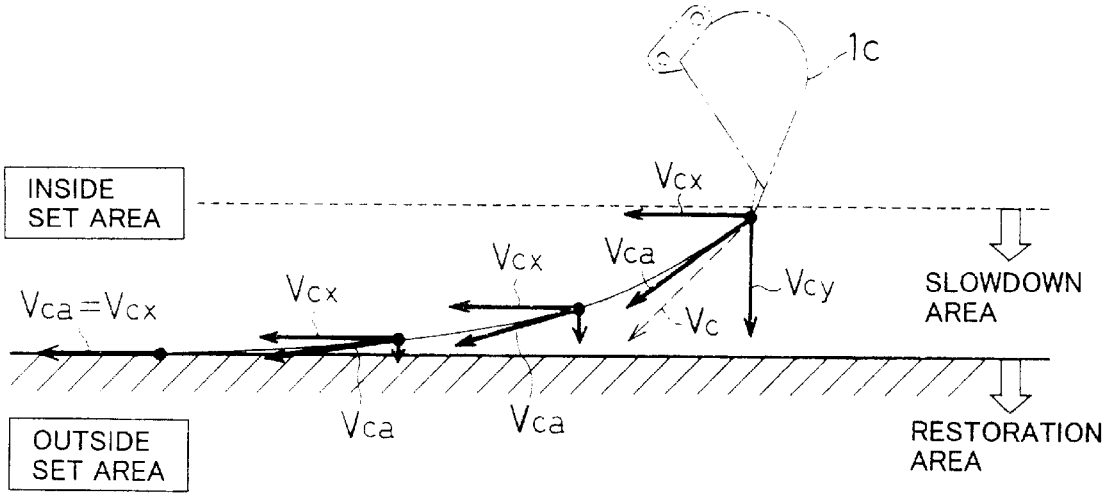
FIG. 31 is an illustrative view showing one example of a locus along which the bucket end is moved under slowdown control as per modification.

FIG. 31 shows one example of a locus along which the end of the bucket 1*c* is moved when the slowdown control is performed as per the modified target speed vector Vca as described above. More specifically, given that the target speed vector Vc is oriented downward obliquely and constant, its parallel component Vcx remains the same and its vertical component Vcy is gradually reduced as the end of the bucket 1*c* comes closer to the boundary of the set area (i.e., as the distance D1 decreases from Ya1). Since the modified target speed vector Vca is a resultant of both the parallel and vertical components, the locus is in the form of a curved line which is curved so as to become parallel by degrees while approaching the boundary of the set area, as shown in FIG. 31. Also, because of h=1 and $V_R$=−Vcy at D1=0, the modified target speed vector Vca on the boundary of the set area coincides with the parallel component Vcx.

The determination in step 170 as to whether or not the bucket end is outside the set area, and the manner of modifying the operation signals in step 180 when the bucket end is outside the set area, will now be described with reference to FIGS. 32 and 33.

Figure 32:
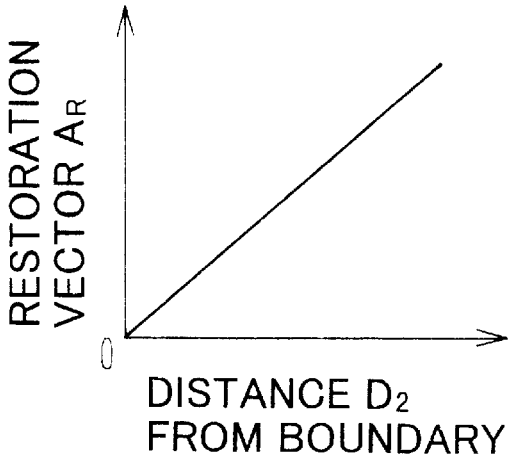
FIG. 32 is a graph showing the relationship between the distance to the bucket end from the boundary of the set area and a restoration vector.

The memory of the control unit 9C further stores the relationship between a distance D2 to the end of the bucket 1*c* locating outside the set area from the boundary of the set area and a restoration vector $A_R$, as shown in FIG. 32. The relationship between the distance D2 and the restoration vector $A_R$ is set such that the restoration vector $A_R$ is gradually increased as the distance D2 increases. The distance D2 corresponds to an absolute value of the Ya-coordinate value of the front end position determined in step 150.

In step 170, the control unit determines that the bucket end has moved out of the set area, if the Ya-coordinate value of the front end position determined in step 150 changes from positive to negative.

In step 180, the Ya-coordinate value of the front end position determined in step 150 is taken as the distance D2, and the restoration vector $A_R$ is determined from the distance D2. Then, the target speed vector Vc is modified by using the restoration vector $A_R$ such that the vector component of the target speed vector Vc at the end of the bucket 1*c* in the direction vertical to the boundary of the set area which has been calculated in step 160, i.e., the Ya-coordinate component Vcy on the XaYa-coordinate system, is changed to a vertical component in the direction toward the boundary of the set area.

More specifically, a reversed vector Acy of Vcy is added to the vertical vector component Vcy to cancel it, and the parallel vector component Vcx is extracted. With this modification, the end of the bucket 1*c* is prevented from further moving out of the set area. Then, the restoration vector $A_R$ is further added to the vertical vector component Vcy of the target speed vector Vc. Here, the restoration vector $A_R$ is a reversed speed vector which is gradually reduced as the distance D2 between the end of the bucket 1*c* and the boundary of the set area decreases. By adding the restoration vector $A_R$ to the vertical vector component Vcy of the target speed vector Vc, therefore, the target speed vector Vc is modified into a target speed vector Vca of which vertical vector component is gradually reduced as the distance D2 decreases.

Figure 33:
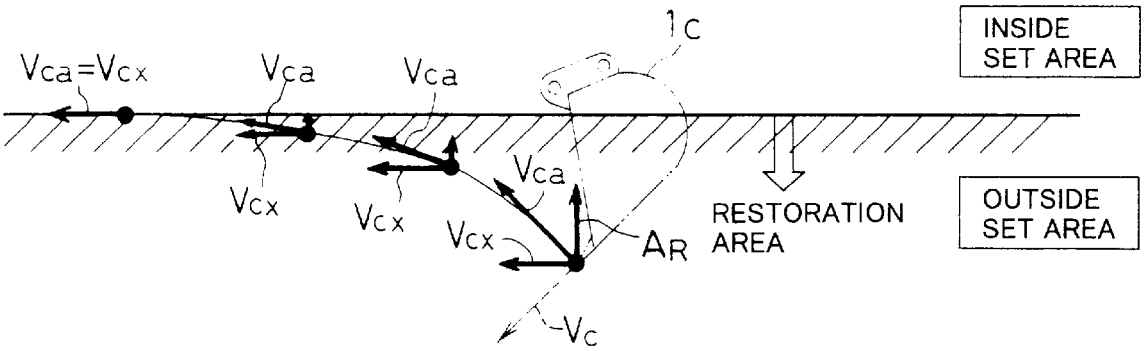
FIG. 33 is an illustrative view showing one example of a locus along which the bucket end is moved under restoration control as per modification.

FIG. 33 shows one example of a locus along which the end of the bucket 1*c* is moved when the restoration control is performed as per the modified target speed vector Vca described above. More specifically, given that the target speed vector Vc is oriented downward obliquely and constant, its parallel component Vcx remains the same, and since the restoration vector $A_R$ is in proportion to the distance D2, the vertical component is gradually reduced as the end of the bucket 1*c* comes closer to the boundary of the set area (i.e., as the distance D2 decreases). Since the modified target speed vector Vca is a resultant of both the parallel and vertical components, the locus is in the form of a curved line which is curved so as to become parallel by degrees while approaching the boundary of the set area, as shown in FIG. 33.

Accordingly, with this embodiment, when the bucket end is inside the set area, the component of the bucket end speed vertical to the boundary of the set area is restricted in accordance with the distance D to the bucket end from the boundary. Therefore, in the boom-down operation, the bucket end can be easily and smoothly positioned, and in the arm crowding operation, the bucket end can be moved along the boundary of the set area. This enables the excavation to be efficiently and smoothly performed within a limited area.

When the bucket end is outside the set area, the front device is controlled to return to the set area in accordance with the distance D to the bucket end from the boundary. Therefore, even when the front device is moved quickly, the front device can be moved along the boundary of the set area and the excavation can be precisely performed within a limited area.

Further, since the bucket end is slowed down under the slowdown control (direction change control) before reaching the boundary of the set area as described above, an amount by which the bucket end projects out of the set area is reduced and a shock caused upon the bucket end returning to the set area is greatly alleviated. Therefore, even when the front device is moved quickly, the front device can be smoothly moved in the set area and the excavation can be smoothly performed within a limited area.

Moreover, with this embodiment, when respective angular speeds of the front members for use in control are determined, the angular speed of each front member is estimated by taking the sum of the low-frequency component of the actual angular speed derived by differentiating the output of the angle sensor, and the high-frequency component of the commanded angular speed derived from the control lever signal by using the metering table. Therefore, the estimated angular speed is free from the effect caused by change in the load imposed upon the front members, the fluid temperature, etc., and a delay in the calculation process occurred at the start-up of the front device is compensated, thus resulting in highly accurate control.

In the calculation estimate of the angular speed, the accuracy of the low-frequency component $\Omega_{11}$ representing an actually measured value resulted from differentiating the output of the angle sensor depends on how many cycles go back from a current value to determine the output value from the angle sensor that is to be used for the differentiation. That accuracy can be kept substantially constant, as stated above, by making differentiation using the output value before a relatively large number of cycles when the magnitude of the operation signal $S_{4b}$ is small, and by making differentiation using the output value before a relatively small number of cycles when the magnitude of the operation signal $S_{4b}$ is large. Further, the accuracy of the filtering process can also be kept constant by performing the filtering process with a relatively low cutoff frequency when the magnitude of the operation signal $S_{4b}$ is small, and with a relatively high cutoff frequency when the magnitude of the operation signal $S_{4b}$ is large.

In addition, by appropriately selecting the gain k to be multiplied by the high-frequency component $\Omega_{2h}$ of the commanded angular speed, the compensation for a delay at the time of signal rising can be set to an optimum degree.

While several typical embodiments of the present invention have been described above, the present invention is not limited to those embodiments, but may be modified in various ways.

For example, in the foregoing embodiments, the load compensation is performed by detecting the load pressure of, e.g., the boom cylinder with the pressure sensor, and modifying the operation signal based on the estimated operating speed of the corresponding front member and the detected load pressure. But it has been confirmed that the load compensation can be performed with a practically satisfactory degree by estimating an operating speed for use in control with a combination of a low-frequency component of the actual operating speed and a high-frequency component of the commanded operating speed. Thus, compensating the operation signal based on the load pressure (i.e., load compensation) is not necessarily essential.

Such compensation based on the load pressure is implemented by setting flow rate characteristics (design values) of related flow control valves in control programs beforehand, and modifying the flow rate characteristics depending on respective load pressures. However, actual flow rate characteristics of the flow control valves practically used are varied product by product. Even when the flow rate characteristics set as design values are modified based on the load pressures, characteristic variations product by product cannot be eliminated and there is a limitation in improving the control accuracy. Further, the need of a pressure sensor for detecting the load pressure pushes up the cost.

Even with the control process not including the compensation of the operation signal based on the load pressure (i.e., load compensation), the control accuracy can be achieved with a practically satisfactory degree by setting flow rate characteristics of flow control valves to typical values depending on the valve type used, and estimating an arm operating speed in accordance with the present invention.

Also, in the foregoing embodiments, the distance D to the bucket end from the boundary L of the set area is employed for the area limiting excavation control. From the viewpoint of implementing the invention in a simpler way, however, the distance to a pin at the arm end from the boundary of the set area may be employed instead. Further, when an area is set for the purpose of preventing interference of the front device with other members and ensuring safety, a predetermined part of the front device may be any other part giving rise to such interference.

While the hydraulic drive system to which the present invention is applied has been described as an open center system including the flow control valves of open center type, the invention is also applicable to a closed center system including flow control valves of closed center type.

Additionally, while the area limiting excavation control has been described as an example of front control in hydraulic excavators, the invention may also be applied to other types of front control, such as interference preventing control for preventing interference between the front device and a surrounding object, interference preventing control for preventing interference between the front device and the cab, etc.

What is claimed is:

1. A front control system equipped on a construction machine comprising a multi-articulated front device made up of a plurality of front members rotatable in the vertical direction, a plurality of hydraulic actuators for driving respectively said plurality of front members, a plurality of operating means for instructing respective operations of said plurality of front members, and a plurality of hydraulic control valves driven in accordance with respective operation signals input from said plurality of operating means for controlling flow rates of a hydraulic fluid supplied to said plurality of hydraulic actuators, said front control system comprising first detecting means for detecting status variables in relation to a position and posture of said front device; first calculating means for calculating the position and posture of said front device based on signals from said first detecting means; and second calculating means employing a signal from a first particular one of said plurality of operating means and estimating an operating speed of a first particular front member driven by a first particular hydraulic actuator associated with said first particular operating means based on the position and posture of said front device calculated by said first calculating means, said estimated operating speed being utilized to control the operation of said front device, wherein:

said second calculating means includes first calculation/filter means for deriving a low-frequency component of an actual operating speed of said first particular front member based on the signal from said first detecting means, second calculation/filter means for deriving a high-frequency component of a commanded operating speed of said first particular front member based on the signal from said first particular operating means, and compositely calculating means for combining the low-frequency component of said actual operating speed and the high-frequency component of said commanded operating speed with each other to estimate the operating speed of said first particular front member for use in said control operation of said front device.

2. A front control system for a construction machine according to claim 1, wherein said first calculation/filter means includes means for differentiating the signal from said first detecting means and deriving the actual operating speed of said first particular front member, and means for performing a low-pass filter process on said actual operating speed, and said second calculation/filter means includes means for deriving the commanded operating speed of said first particular front member based on the signal from said first particular operating means, and means for performing a high-pass filter process on said commanded operating speed.

3. A front control system for a construction machine according to claim 2, wherein said means included in said first calculation/filter means for deriving the actual operating speed includes cycle number calculating means for determining the number of calculation cycles to take in the signal from said first detecting means in accordance with the signal from said first particular operating means, storage means for storing the signal from said first detecting means in the determined number of calculation cycles, including the latest calculation cycle, and means for calculating the actual operating speed of said first particular front member in accordance with a formula below;

$$\Omega_1=(\alpha_a-\alpha_{a-n})/(T\times n)$$

where the number of calculation cycles is n, the signal from said first detecting means in the latest calculation cycle is $\alpha_a$, the signal from said first detecting means before n cycles is $\alpha_{a-n}$, the period of one calculation cycle is T, and the actual operating speed of said first particular front member is $\Omega_1$.

4. A front control system for a construction machine according to claim 3, wherein said cycle number calculating means determines the number n of calculation cycles such that the number of calculation cycles is reduced as the signal from said first particular operating means increases.

5. A front control system for a construction machine according to claim 4, wherein said means included in said second calculation/filter means for performing a high-pass filter process calculates a cutoff frequency that rises as the signal from said first particular operating means increases, and performs the high-pass filter process on said commanded operating speed by using the calculated cutoff frequency.

6. A front control system for a construction machine according to claim 4, wherein said means included in said first calculation/filter means for performing a low-pass filter process calculates a cutoff frequency that rises as the signal from said first particular operating means increases, and performs the low-pass filter process on said actual operating speed by using the calculated cutoff frequency.

7. A front control system for a construction machine according to claim 1, wherein said compositely calculating means includes means for adding the low-frequency component of said actual operating speed and the high-frequency component of said commanded operating speed.

8. A front control system for a construction machine according to claim 7, wherein said compositely calculating means further includes means for multiplying a gain by the high-frequency component of said commanded operating speed, and said adding means adds the product resulted from multiplying said gain by the high-frequency component of said commanded operating speed and the low-frequency component of said actual operating speed.

9. A front control system for a construction machine according to claim 1, wherein said front control system further comprises:

area setting means for setting an area where said front device is allowed to move;

third calculating means employing the operating speed of said first particular front member estimated by said second calculating means and estimating an operating speed of said front device based on the position and posture of said front device calculated by said first calculating means;

fourth calculating means employing the operating speed of said front device estimated by said third calculating means and calculating, based on the position and posture of said front device calculated by said first calculating means, a limit value of an operating speed of a second particular front member required for limiting a speed of said front device moving in the direction toward a boundary of said set area, when said front device is positioned inside said set area near the boundary thereof and said first particular front member is being moved at said estimated operating speed; and signal modifying means for modifying a signal from a second particular operating means associated with said second particular front member so that the operating speed of said second particular front member will not exceed said limit value;

said signal modifying means calculating a limit value of the signal from said second particular operating means based on said limit value of the operating speed of said second particular front member and modifying the signal from said second particular operating means so that the signal from said second particular operating means will not exceed said limit value calculated by the signal modifying means.

10. A front control system for a construction machine according to claim 1, wherein the actual operating speed and the commanded operating speed of said first particular front member are both associated with said first particular hydraulic actuator.

11. A front control system for a construction machine according to claim 1, wherein the actual operating speed and the commanded operating speed of said first particular front member are both associated with an angular speed of said first particular front member.

12. A front control system for a construction machine according to claim 1, wherein said first particular front member is an arm of a hydraulic excavator and said second particular front member is a boom of the hydraulic excavator.

13. A recording medium recording a control program for controlling operation of a multi-articulated front device made up of a plurality of front members rotatable in the vertical direction with a computer, wherein:

said control program instructs said computer to calculate a position and posture of said front device, estimate an operating speed of first particular one of said plurality of front members based on the calculated position and posture of said front device, and calculate an operation command value for said front device by using the estimated operating speed, and said control program further instructs said computer, when estimating the operating speed of said first particular front member, to derive a low-frequency component of an actual operating speed of said first particular front member and a high-frequency component of a commanded operating speed of said first particular front member, and combine the low-frequency component of said actual operating speed and the high-frequency component of said commanded operating speed with each other, to estimate the operating speed of said first particular front member for use in the controlling operation of said front device.

* * * * *